US011035529B2

(12) United States Patent
Poirier et al.

(10) Patent No.: US 11,035,529 B2
(45) Date of Patent: Jun. 15, 2021

(54) ELECTRONIC TWIST FLARE

(71) Applicant: Northern Optotronics Inc., Orillia (CA)

(72) Inventors: Jean Marc Poirier, Severn (CA); Geoffrey James Miller, Barrie (CA)

(73) Assignee: Northern Optotronics Inc., Orillia (CA)

( * ) Notice: Subject to any disclaimer, the term of this patent is extended or adjusted under 35 U.S.C. 154(b) by 0 days.

(21) Appl. No.: 16/577,399

(22) Filed: Sep. 20, 2019

(65) Prior Publication Data

US 2020/0240597 A1 Jul. 30, 2020

Related U.S. Application Data

(60) Provisional application No. 62/798,030, filed on Jan. 29, 2019.

(51) Int. Cl.
*F21L 4/02* (2006.01)
*F21L 4/08* (2006.01)
(Continued)

(52) U.S. Cl.
CPC ..... *F21L 4/02* (2013.01); *F21L 4/08* (2013.01); *F21V 23/0414* (2013.01);
(Continued)

(58) Field of Classification Search
CPC ..... F21L 4/02; F21L 4/08; F21V 23/0414; F21V 23/0442
(Continued)

(56) References Cited

U.S. PATENT DOCUMENTS 4,432,043 A * 2/1984 Yuen ..... F21L 2/00 200/60
4,782,432 A * 11/1988 Coffman ..... F21V 23/0414 362/184
(Continued)

FOREIGN PATENT DOCUMENTS

CA 2072970 A1 3/1992
WO 2007/134179 A2 11/2007

OTHER PUBLICATIONS

The Drive, "Best LED Road Flares: Our Top Picks for Roadside Safety", online review, Acton Media Inc., Mar. 22, 2019 <https://www.thedrive.com/reviews/27069/best-led-road-flares> (11 pages).
(Continued)

*Primary Examiner* — Bryon T Gyllstrom
(74) *Attorney, Agent, or Firm* — Bereskin & Parr LLP/S.E.N.C.R.L., s.r.l.; Tony Orsi

(57) ABSTRACT

Various embodiments of electronic flares are described which generally comprise a light module that is disposed along a portion of a housing and includes at least one light source for emitting light according to a lighting mode, a power source for providing power to the light module, a circuit board that is disposed within the housing and is electrically coupled to the power source and light module, the circuit board including a controller for providing power to the light module according to the selected lighting mode when the electronic flare is activated; and a switch having an external switch portion and an internal switch portion coupled to one another, the external switch portion being disposed along an outer portion of the housing and the internal switch portion being operatively coupled to the circuit board, the external switch portion being rotatably movable by a user to one or more positions where each
(Continued)

position is associated with a different lighting mode allowing the user to select the lighting mode.

30 Claims, 30 Drawing Sheets

(51) Int. Cl.
*F21V 23/04* (2006.01)
*F21Y 115/10* (2016.01)
*F21Y 113/10* (2016.01)

(52) U.S. Cl.
CPC ..... *F21V 23/0442* (2013.01); *F21Y 2113/10* (2016.08); *F21Y 2115/10* (2016.08)

(58) Field of Classification Search
USPC ..... 362/157
See application file for complete search history.

(56) References Cited

U.S. PATENT DOCUMENTS 5,008,785 A * 4/1991 Maglica ..... F21V 31/03 362/183
5,193,898 A * 3/1993 Maglica ..... F21L 4/005 362/183
5,528,472 A * 6/1996 Maglica ..... F21L 4/005 200/60
6,585,391 B1 * 7/2003 Koch ..... F21V 23/0464 362/205
2004/0105258 A1 * 6/2004 Galli ..... G02F 1/1339 362/205
2005/0264261 A1 12/2005 Barbeau et al.
2007/0258236 A1 * 11/2007 Miller ..... F21L 4/027 362/205
2008/0211428 A1 * 9/2008 Bayat ..... F21V 7/0091 315/299
2010/0219775 A1 * 9/2010 Maglica ..... F21V 23/0421 315/362
2010/0254135 A1 * 10/2010 Bayat ..... F21V 23/0414 362/235
2011/0103048 A1 5/2011 Kennedy et al.
2014/0198484 A1 7/2014 Feustel et al.
2018/0010777 A1 1/2018 Wills et al.
2018/0224109 A1 8/2018 Selevan et al.
2020/0248893 A1 * 8/2020 Jeon ..... F21K 9/65

OTHER PUBLICATIONS

Collins, "The Best Road Flare", online review, Feb. 20, 2019 <https://www.carbibles.com/road-flares> (16 pages).
Examiner's Report dated Mar. 17, 2021 in CA Patent Application No. 3,069,665 (9 pages).

* cited by examiner

ELECTRONIC TWIST FLARE

CROSS-REFERENCE

This application claims the benefit of U.S. Provisional Patent Application No. 62/798,030 filed Jan. 29, 2019; the entire contents of Patent Application No. 62/798,030 are hereby incorporated by reference.

FIELD

This application relates to devices used for signaling in emergencies. More particularly, this application provides an electronic flare with multi-mode functionality, capable of being used in many situations.

BACKGROUND

Warning devices are often used in emergencies. A warning device may indicate the location of an accident to emergency personnel or warn others to stay away from the location. For example, a car crash victim may use a warning device to signal their location to emergency personnel, while emergency personnel may use a warning device to warn other drivers to keep away.

Traditionally, warning devices have been pyrotechnic flares. Pyrotechnic flares are extremely dangerous due to their ease of ignition and high temperatures reached, often burning their users. Due to their high temperature, pyrotechnic flares may also start fires, especially at the site of an accident with spilled oil or gas, or in a wooded area. Pyrotechnic flares are often a costly requirement for boat safety regulations, as they must be replaced whenever they expire (roughly every four years). An additional challenge with flares for boating use is the requirement to keep them in dry conditions to ensure that they function properly. Any amount of moisture may make a pyrotechnic flare non-functional. Furthermore, upon expiration, pyrotechnic flares must be disposed of, thereby posing a safety concern and an environmental hazard. The lifetime of pyrotechnic flares is often too short to last the span of an emergency, which requires the use of numerous and expensive pyrotechnic flares. Furthermore, pyrotechnic flares can only emit one colour of light in a steady fashion, and may be confused with an ordinary light or firework.

SUMMARY

In accordance with one broad aspect of the teachings herein, there is provided an electronic flare comprising a long tubular housing; a light module that is disposed along a portion of the housing, the light module comprising at least one light source for emitting light according to a lighting mode; a power source for providing power to the light module; a circuit board that is disposed within the housing and is electrically coupled to the power source and light module, the circuit board including a controller for providing power to the light module according to the selected lighting mode when the electronic flare is activated; and a switch having an external switch portion and an internal switch portion coupled to one another, the external switch portion being disposed along an outer portion of the housing and the internal switch portion being operatively coupled to the circuit board, the external switch portion being rotatably movable by a user to one or more positions where each position is associated with a different lighting mode allowing the user to select the lighting mode.

In at least one embodiment, the lighting modes comprise a first mode where the light module is deactivated and an at least one additional lighting mode in which the light module is activated.

In at least one embodiment, the at least one additional lighting mode comprises at least one of a second lighting mode where the light module emits a steady light, a third lighting mode where the light module emits a flashing light and a third lighting mode where the light module emits light according to a Morse code pattern.

In at least one embodiment, the lighting provided during a given lighting mode is programmable by a user by providing lighting instructions to the controller.

In at least one embodiment, the light module comprises: a light source containment member that provides a housing for the light module; at least one light source contact holder for supporting the at least one light source; and at least one light source contact member that is electrically connectable to the at least one light source and the circuit board for providing power to the at least one light source depending on the selected lighting mode.

In at least one embodiment, the light module is removably attachable to the housing allowing the light module to be replaced when any of the light sources are damaged or allowing the light module to be replaced with another light module having light sources that emit light of a different color.

In at least one embodiment, the external switch portion has a rough surface allowing the user to more easily grip and actuate the switch.

In at least one embodiment, the internal switch portion is a rotary switch and the circuit board comprises a plurality of electrical contacts that are physically located at different positions that correspond to the different positions that the rotary switch is movable to so that during use the user can rotate the external switch portion which in turn rotates the rotary switch to select one of the lighting modes.

In at least one embodiment, the internal switch portion is a rotary switch with an internal surface that includes different optical markers that are spaced apart and correspond to different lighting modes, the circuit board comprises an optical detector for detecting the optical markers and during use the rotary switch is rotated by rotation of the external switch portion to allow one of the optical markers to be detected by the optical detector to allow the user to select the lighting mode associated with the detected optical marker.

In at least one embodiment, the electronic flare further comprises a tactile feedback mechanism to provide the user with tactile feedback when the external switch portion is rotated to different positions.

In at least one embodiment, the internal switch portion is a rotary switch and the tactile feedback mechanism comprises a resilient member that is adapted to exert an outwardly radial force on different slots in an internal surface of the rotary switch where each slot corresponds to a lighting mode and actuation of the rotary switch to change from a given lighting mode to another lighting mode results in deflection of the resilient member that provides the tactile feedback to the user.

In at least one embodiment, the resilient member comprises a spring and the tactile feedback mechanism comprises a ball bearing that is at an end of the spring and is disposed within the slot corresponding to the given lighting mode and during actuation, the spring is compressed when the rotary switch is rotated until the ball bearing is moved to another slot corresponding to a different lighting mode at which point the spring is adapted to move from a contracted to an extended position to provide the tactile feedback to the user.

In at least one embodiment, the resilient member comprises a spring and the tactile feedback mechanism comprises two ball bearings that are at opposite ends of the spring and are disposed within the a pair of slots that correspond to the given lighting mode and during actuation, the spring is compressed when the rotary switch is rotated until the ball bearings are moved to another pair of slots that correspond to a different lighting mode at which point the spring is adapted to move from a contracted to an extended position to provide the tactile feedback to the user.

In at least one embodiment, the electronic flare further comprises an activation block having a recess, the activation block being coupled to the external switch portion such that rotation of the external switch portion rotates the activation block; and the internal switch portion is a rotary switch that has a protrusion that corresponds to the recess of the activation block, the rotary switch protrusion being coupled to the activation block recess such that the rotary switch is adapted to rotate upon rotation of the activation block.

In at least one embodiment, the internal switch portion comprises at least one light transmitter coupled to the circuit board; a vane assembly comprising a support block coupled to the housing; at least one phototransistor that is associated with the at least one light transmitter, the at least one phototransistor being configured for receiving light from the at least one phototransistor light source; and a vane that is rotatably coupled to the support block and coupled to the external switch portion, the vane having a light vent, the vane being adapted to rotate when the external switch portion is rotated to allow transmitted light from the at least one light transmitter to be detected by the associated at least one phototransistor when the vane is therebetween and the vane being adapted to block the light otherwise, wherein the controller is adapted to switch the lighting mode when the associated at least one light transmitter transitions between detecting and not detecting the transmitted light from the at least one light phototransmitter.

In at least one embodiment, the electronic flare further comprises a first lighting mode when the at least one phototransistor detects the transmitted light and a second lighting mode when the at least one phototransistor does not detect the transmitted light.

In at least one embodiment, the electronic flare further comprises a first light phototransistor for detecting light from a first light transmitter and a second phototransistor for detecting light from a second light transmitter and the controller is configured to enter select different lighting modes depending on whether one or both of the phototransistors detect transmitted light.

In at least one embodiment, the controller is further configured to use any one of a binary code and a gray code to change between the lighting modes depending on which of the phototransistors detect transmitted light.

In at least one embodiment, the controller is configured to determine time durations during which the light vane is in a particular position during a sequence of rotations of the vane and the controller is configured to select a lighting mode based on the determined time durations and changes in rotation direction for the sequence of rotations has at least a first lighting position and a second lighting position.

In at least one embodiment, the power source is a battery disposed at an end of the electronic flare.

In these embodiments, the battery is rechargeable and an end cap that is adjacent to the battery comprises electrical contacts to facilitate direct electrical charging or charging occurs through wireless induction.

In at least one embodiment, the electronic flare comprises sealing elements disposed along different physical and/or removable sections of the housing to seal keep fluids from entering the housing.

In at least one embodiment, the electronic flare comprises an alternate activation mechanism including a button that is actuated by a user to select one of the lighting modes.

In at least one embodiment, the electronic flare comprises an alternate activation mechanism including an impact switch that is actuated by a user by exerting an external impact force on the housing to select one of the lighting modes.

In at least one embodiment, the electronic flare further comprises a photosensor that is electrically coupled to the circuit board and is adapted to sense ambient light, and when the photosensor is exposed to a low amount of ambient light the controller is configured to increase power to the light module to increase an amount of emitted light when the light module is activated and when the photosensor is exposed to a high amount of ambient light the controller is configured to decrease power to the light module to decrease an amount of emitted light when the light module is activated.

In at least one embodiment, an end cap is shaped to receive a removably attachable mount that has a pointed end for allowing the electronic flare to be mounted on a soft surface.

In at least one embodiment, the electronic flare further comprises a removably attachable mount that has at least one clamp that is coupled to a stand, the at least one clamp being sized to receive the housing and couple the mount to the housing to maintain the electronic flare at an upright position on a surface.

In at least one embodiment, the stand is pivotally coupled to the lamp allowed an angle between the housing of the electronic flare and the surface to be adjusted.

In accordance with another broad aspect of the teachings herein, there is provided an electronic flare kit comprising an electronic flare that comprises a long tubular housing; a light module that is disposed along a portion of the housing, the light module comprising at least one light source for emitting light according to a lighting mode; a power source for providing power to the light module; a circuit board that is disposed within the housing and is electrically coupled to the power source and light module, the circuit board including a controller for providing power to the light module according to the selected lighting mode when the electronic flare is activated; and a switch having an external switch portion and an internal switch portion that is coupled to the external switch portion, the external switch portion being disposed along an outer portion of the housing and the internal switch portion being operatively coupled to the circuit board, the external switch portion being rotatably movable by a user to one or more positions where each position is associated with a different lighting mode allowing the user to select the lighting mode.

In at least one embodiment, the electronic flare comprises an end cap shaped to receive a removably attachable mount that has a pointed end for allowing the electronic flare to be mounted on a soft surface.

In at least one embodiment, the electronic flare further comprises a removably attachable mount that has at least one clamp that is coupled to a stand, the at least one clamp being sized to receive the housing and couple the mount to the housing to maintain the electronic flare at an upright position on a surface.

In at least one embodiment, the stand is pivotally coupled to the clamp to allow an angle between the housing of the electronic flare and the surface to be adjusted.

In at least one embodiment, the kit further comprises at least one additional lighting module that is removably attachable to the housing, the additional lighting module having a different light color when illuminated.

In at least one embodiment, the kit further comprises instructions describing how the electronic flare is operated by a user.

These and other features and advantages of the present application will become apparent from the following detailed description taken together with the accompanying drawings. It should be understood, however, that the detailed description and the specific examples, while indicating preferred embodiments of the application, are given by way of illustration only, since various changes and modifications within the spirit and scope of the application will become apparent to those skilled in the art from this detailed description.

BRIEF DESCRIPTION OF THE DRAWINGS

For a better understanding of the various embodiments described herein, and to show more clearly how these various embodiments may be carried into effect, reference will be made, by way of example, to the accompanying drawings which show at least one example embodiment, and which are now described. The drawings are not intended to limit the scope of the teachings described herein.

Figure 1:
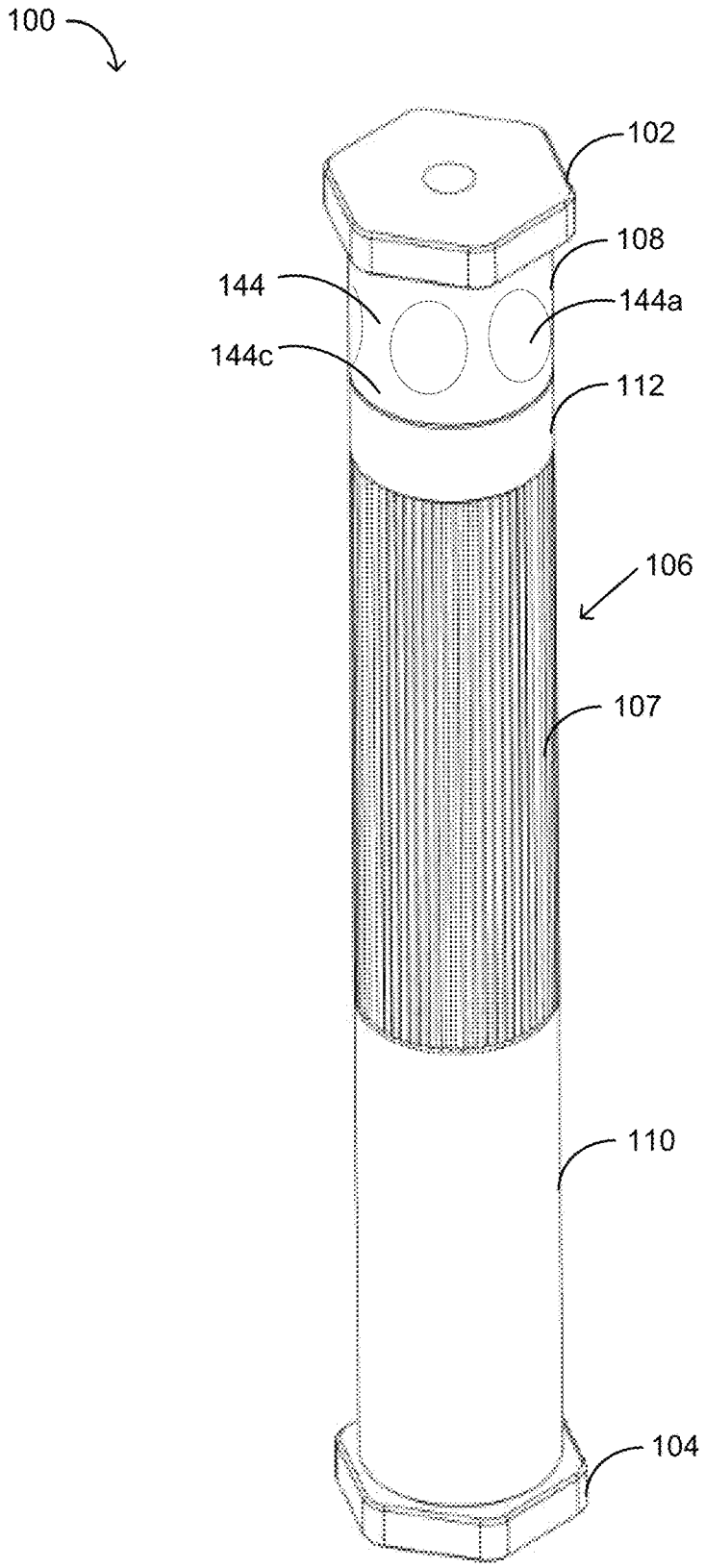
FIG. 1 shows a perspective view of an example embodiment of an electronic flare in accordance with the teachings herein.

Further aspects and features of the example embodiments described herein will appear from the following description taken together with the accompanying drawings.

DESCRIPTION OF EXAMPLE EMBODIMENTS

Various systems, devices or methods will be described below to provide an example of at least one embodiment of the claimed subject matter. No embodiment described herein limits any claimed subject matter and any claimed subject matter may cover systems, devices or methods that differ from those described herein. The claimed subject matter is not limited to systems, devices or methods having all of the features of any one process or device described below or to features common to multiple or all of the systems, devices or methods described herein. It is possible that a system, device or method described herein is not an embodiment of any claimed subject matter. Any subject matter that is disclosed in a system, device or method described herein that is not claimed in this document may be the subject matter of another protective instrument, for example, a continuing patent application, and the applicants, inventors or owners do not intend to abandon, disclaim or dedicate to the public any such subject matter by its disclosure in this document.

Furthermore, it will be appreciated that for simplicity and clarity of illustration, where considered appropriate, reference numerals may be repeated among the figures to indicate corresponding or analogous elements. In addition, numerous specific details are set forth in order to provide a thorough understanding of the embodiments described herein. However, it will be understood by those of ordinary skill in the art that the embodiments described herein may be practiced without these specific details. In other instances, well-known methods, procedures and components have not been described in detail so as not to obscure the embodiments described herein. Also, the description is not to be considered as limiting the scope of the embodiments described herein.

It should also be noted that the terms "coupled" or "coupling" as used herein can have several different meanings depending in the context in which these terms are used. For example, the terms coupled or coupling can have a mechanical, electrical or communicative connotation. For example, as used herein, the terms coupled or coupling can indicate that two or more elements or devices can be directly connected to one another or connected to one another through one or more intermediate elements or devices via an electrical element, electrical signal or a mechanical element depending on the particular context.

It should also be noted that, as used herein, the wording "and/or" is intended to represent an inclusive-or. That is, "X and/or Y" is intended to mean X or Y or both, for example. As a further example, "X, Y, and/or Z" is intended to mean X or Y or Z or any combination thereof.

It should be noted that terms of degree such as "substantially", "about" and "approximately" as used herein mean a reasonable amount of deviation of the modified term such that the end result is not significantly changed. These terms of degree may also be construed as including a deviation of the modified term if this deviation does not negate the meaning of the term it modifies.

Furthermore, the recitation of numerical ranges by endpoints herein includes all numbers and fractions subsumed within that range (e.g. 1 to 5 includes 1, 1.5, 2, 2.75, 3, 3.90, 4, and 5). It is also to be understood that all numbers and fractions thereof are presumed to be modified by the term "about" which means a variation of up to a certain amount of the number to which reference is being made if the end result is not significantly changed, such as 10%, for example.

In accordance with the teachings herein, at least one embodiment is provided for an electronic flare. The electronic flare has a housing that contains a power source, a circuit board, and an actuation mechanism. The electronic flare also comprises a light module that is generally disposed at an end of the housing. In some embodiments, the light module is removably attachable to the housing. Actuating the actuation mechanism activates the light module, which then emits light.

Figure 2A:
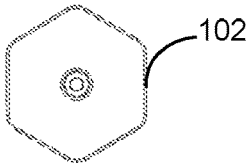
FIGS. 2A-2D show a top view, a side view, a bottom view and a sectional view, respectively, of the electronic flare of FIG. 1.
Figure 2B:
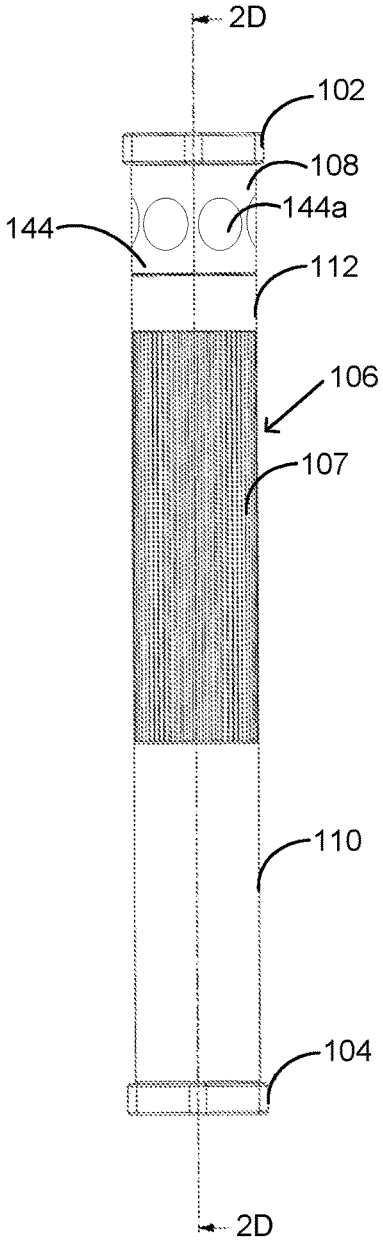
Figure 2C:
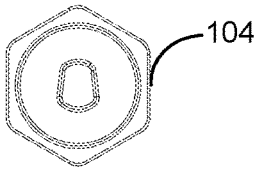

Referring now to FIG. 1, illustrated therein is a perspective view of an example embodiment of an electronic flare 100. The electronic flare 100 includes a top end cap 102, a bottom end cap 104, a twist switch 106, a light module 108, an outer tube 110 and a light source contact holder 112. A top view of the top end cap 102 is shown in FIG. 2A. A bottom view of the bottom end cap 104 is shown in FIG. 2C.

The top end cap 102 is disposed above an upper surface of the light module 108. A bottom surface of the light module 108 is disposed above an upper surface of the light source contact holder 112. A bottom surface of the light source contact holder 112 is disposed above an upper surface of the twist switch 106. The bottom surface of the twist switch 106 is disposed above an upper surface of the outer tube 110. A bottom surface of the outer tube is disposed above an upper surface of the bottom end cap 104. The twist switch 106 generally includes an external switch portion 107, which is tubular and rotatable by a user and may be referred to as a handle, and an internal switch portion which is coupled to the external switch portion 107 and is rotatable when the external switch portion 107 is rotated. The internal switch portion generally comprises a rotary switch such as rotary switch 122.

Figure 2D:
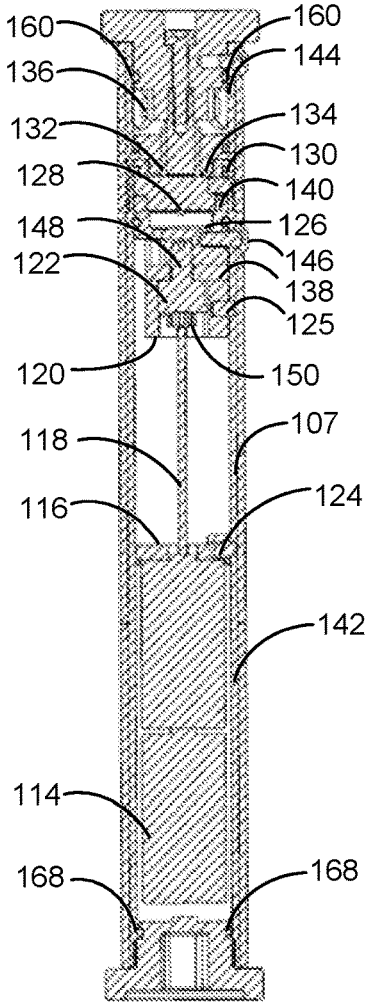

The electronic flare 100 also has an inner tube 142 as shown in FIG. 2D. A bottom end of the inner tube 142 is adjacent an inner portion of the bottom end cap 104. The inner tube 142 extends along an inner surface of the outer tube 110 and an inner surface of the external switch portion 107 so that a top end of the inner tube is adjacent a bottom portion of the light source contact holder 112 such that the light module 108 is coupled with the inner tube 142. The bottom end cap 104 is coupled with the outer tube 110 and the inner tube 142.

Figure 2E:
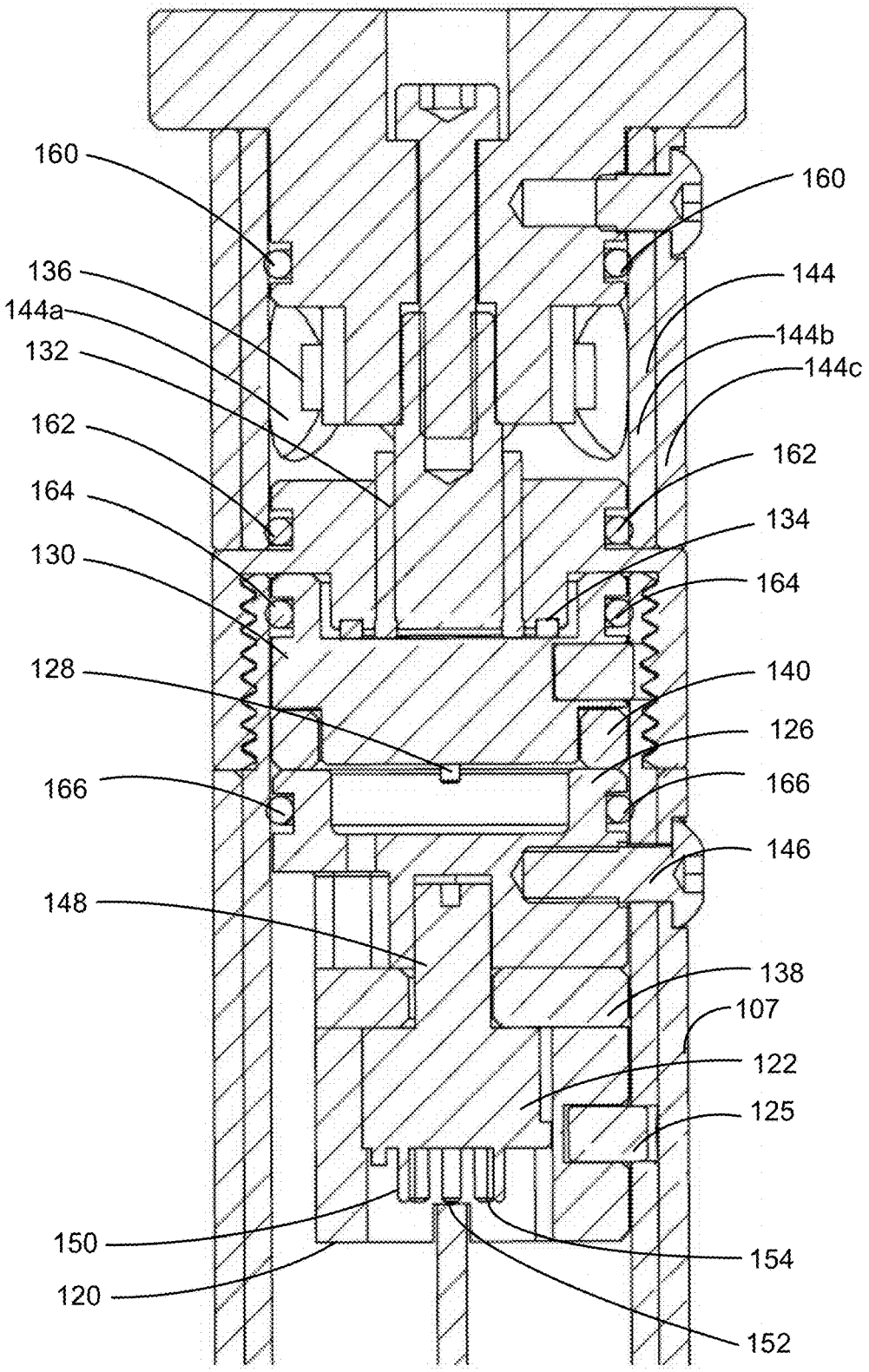
FIG. 2E shows an enlarged view of a portion of FIG. 2D.

When the electronic flare 100 is assembled, it may be sealed to prevent water from entering the interior of the electronic flare 100 through using various elements such as seals. For example, as seen in FIGS. 2D and 2E, there may be a seal 160 between the top end cap 102 and a light source containment tube 144. There may also be a seal 162 between the light source contact holder 112 and the light source containment tube 144. There may also be a seal 164 between the light source contact holder 112 and the inner tube 142. There may also be a seal 166 between an activation block 126 and the inner tube 142. Finally, there may also be a seal 168 between the bottom end cap 104 and the inner tube 142. The seals may be O-rings or other suitable elements. In other embodiments, some of the above noted seals may not be used.

The twist switch 106 has a knurled (i.e. ribbed) surface to allow a user to grip the electronic flare 100 more securely. The knurled surface provides ease of use for a user in actuating the electronic flare 100 either when the user is barehanded or while the user is wearing gloves. The knurled surface may cover the entire external switch portion 107 or just a portion of the external switch portion 107 such as having ribs extending vertically along certain circumferential portions of the external switch portion 107 with smooth surfaces in between.

Alternatively, in some embodiments, the external switch portion 107 does not have a knurled surface, but it is made of a non-slip material. In other embodiments, the external switch portion 107 may have a knurled surface that is made of a non-slip material for additional grip. In some embodiments, the external switch portion 107 has a rough surface for additional grip.

Figure 3:
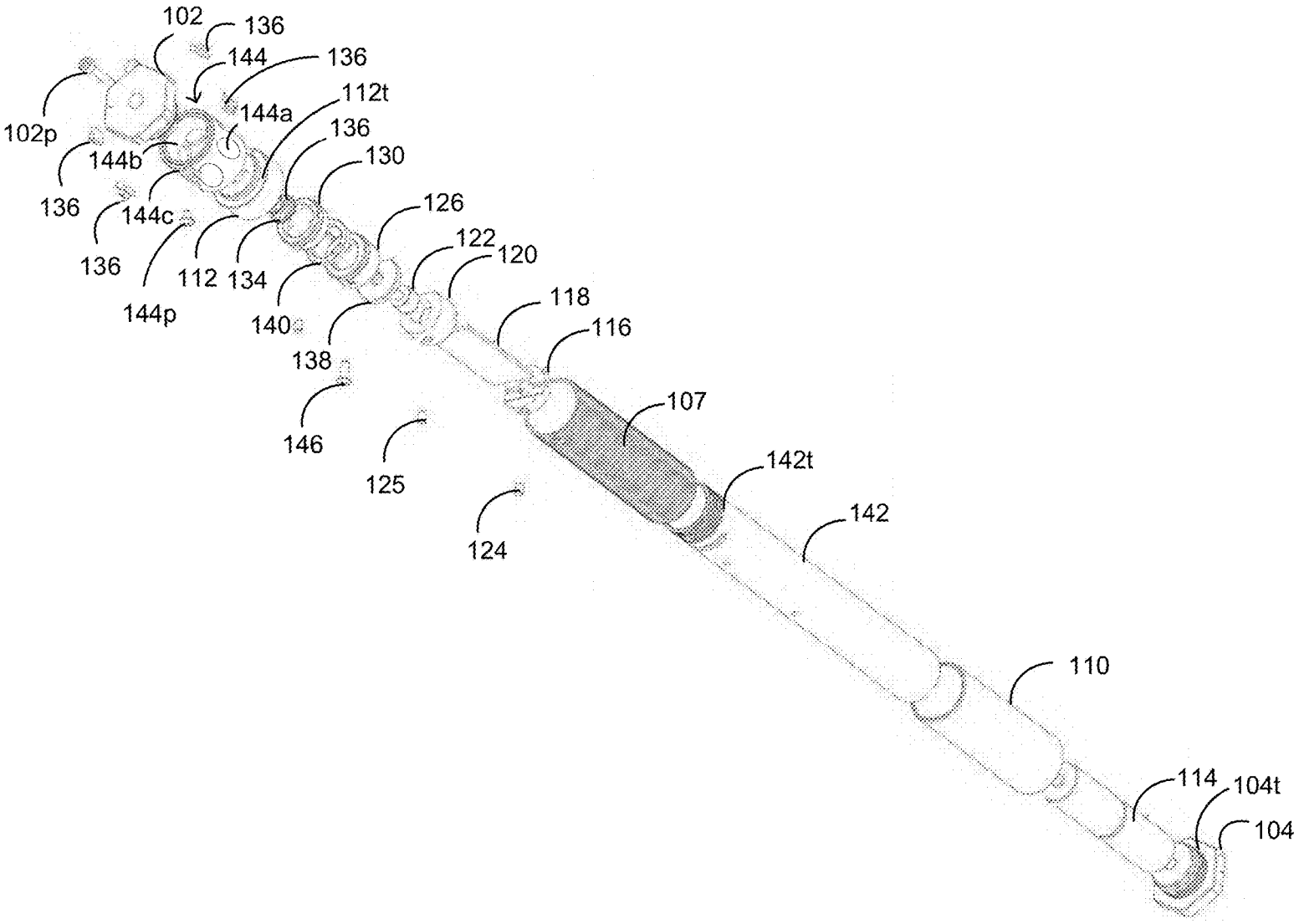
FIG. 3 shows an exploded view of the electronic flare of FIG. 1.
Figure 4:
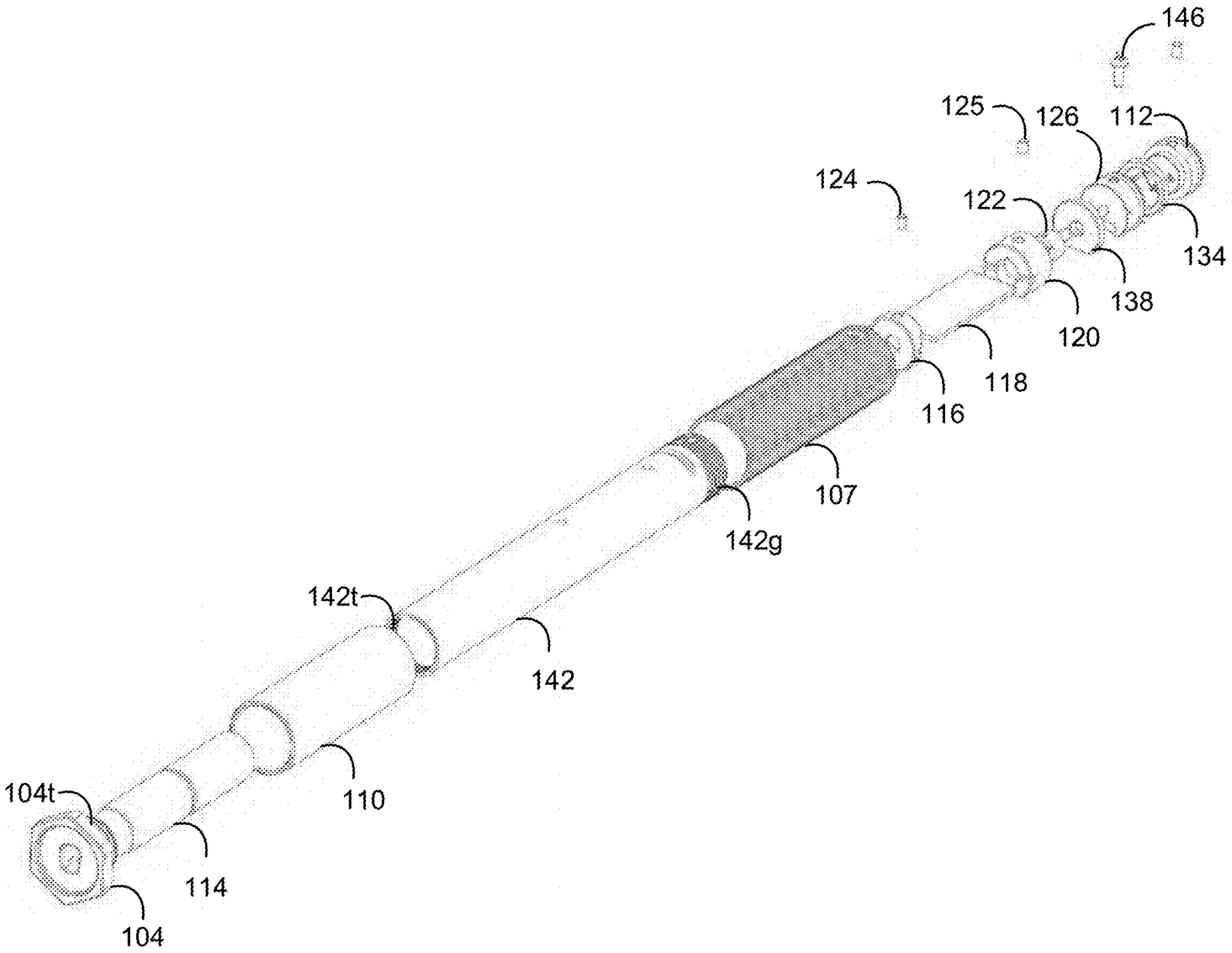
FIG. 4 shows an exploded view of a base of the electronic flare of FIG. 1.
Figure 5A:
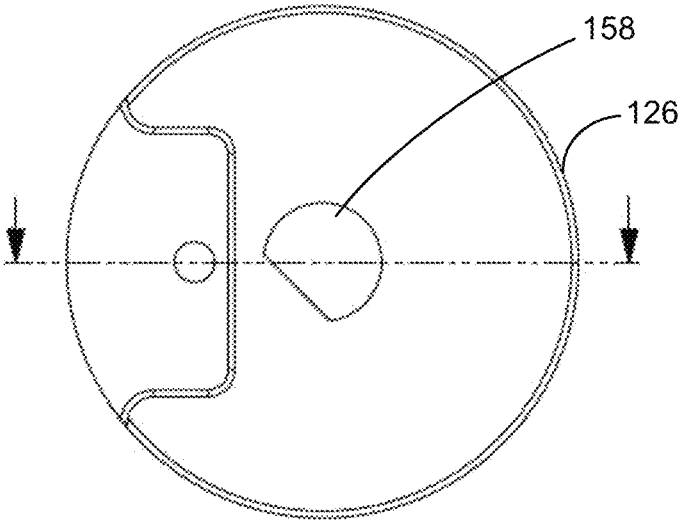
FIG. 5A shows a top view of an activation block of the electronic flare of FIG. 1.
Figure 5B:
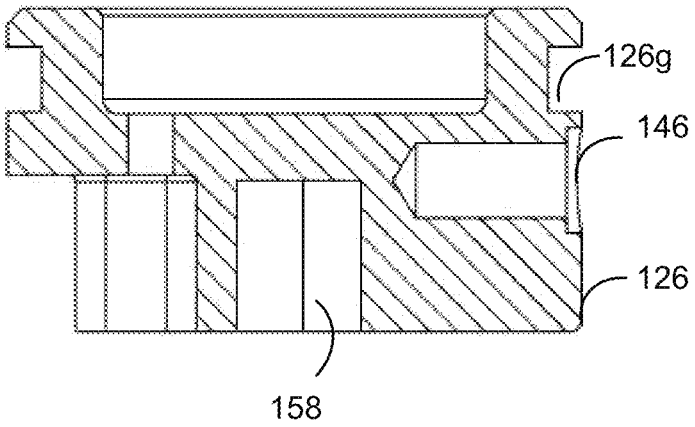
FIG. 5B shows a sectional side view of the activation block of the electronic flare of FIG. 1.
Figure 5D:
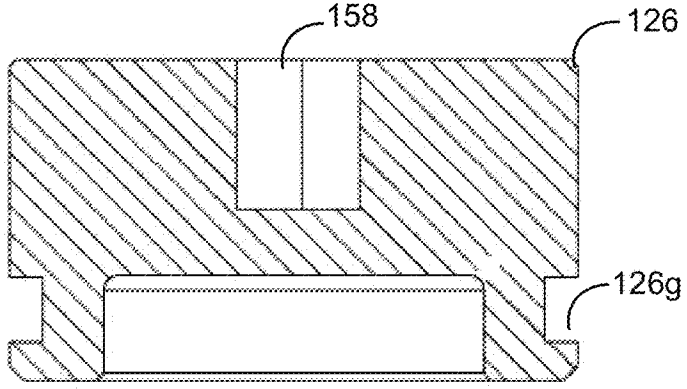
FIG. 5D shows an upside down side sectional view of the activation block of the electronic flare of FIG. 1.
Figure 5E:
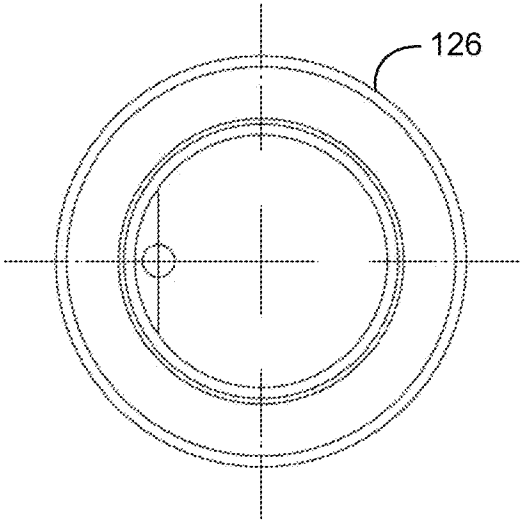
FIG. 5E shows a bottom view of the activation block of the electronic flare of FIG.
Figure 5C:
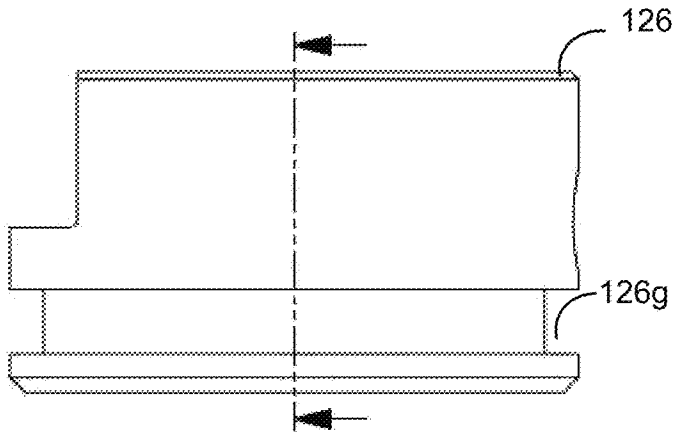
FIG. 5C shows an upside down side view of the activation block of the electronic flare of FIG. 1.
Figure 6A:
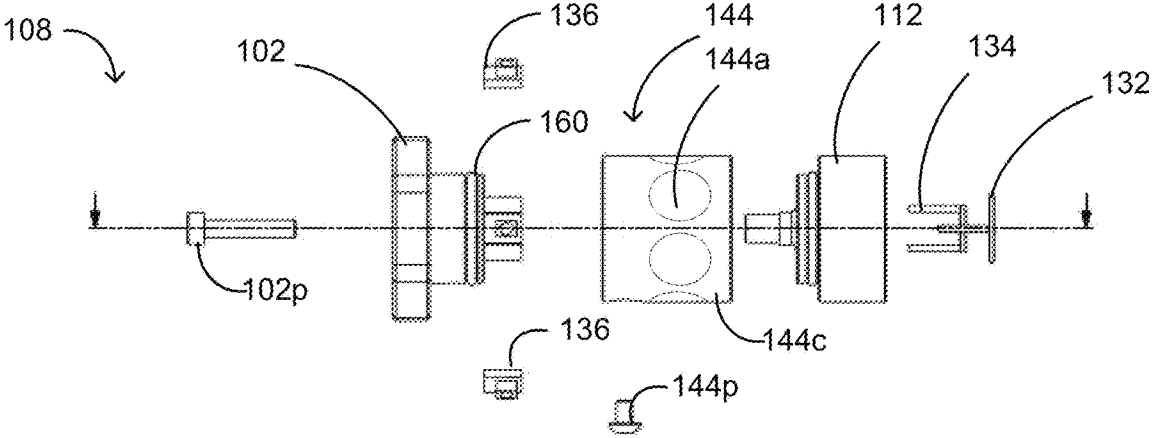
FIGS. 6A-6C show a side view, a perspective view, and a sectional view, respectively, of an example embodiment of a light module that can be used with the electronic flare of FIG. 1 in accordance with the teachings herein.
Figure 6C:
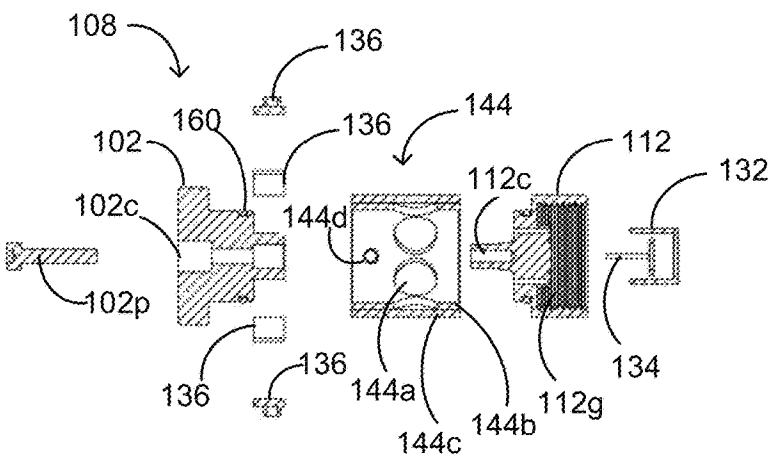
Figure 6B:
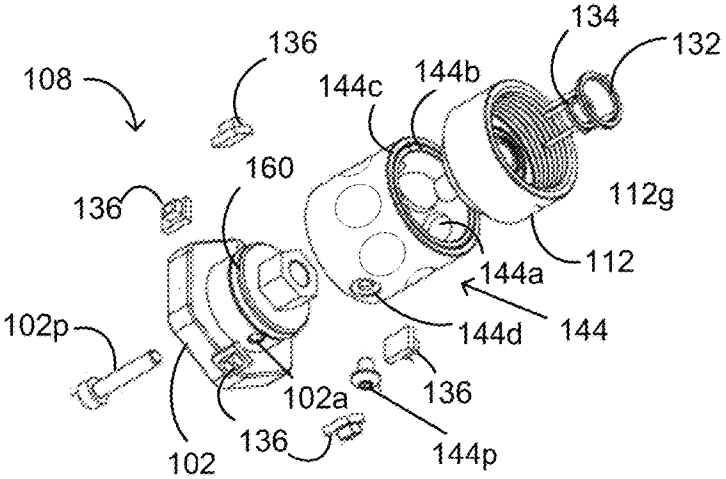

FIG. 3 shows an exploded view of the electronic flare 100. FIG. 4 shows an exploded view of the electronic flare 100 with the light module 108 removed. FIGS. 6A-6C shows an exploded view of the light module 108 of the electronic flare 100.

When the bottom end cap 104 is decoupled from the inner tube 142 and the outer tube 110, a power source 114 may be inserted into the inner tube 142. After the power source 114 has been inserted into the inner tube 142, the bottom end cap 104 may be removably coupled to the inner tube 142 and the outer tube 110. In some embodiments, the power source 114 may be one or more batteries. In some embodiments, the power source 114 may be rechargeable. In some embodiments, the power source 114 may be integrated into the electronic flare and may not be removable.

The electronic flare 100 also includes a circuit board 118 that is disposed within the inner tube 142. A first end of the circuit board 118 is held in place by making a friction fit with a slot in a first support 116. A second end of the circuit board 118 is held in place by making a friction fit with a slot in a second support 120. At least a portion of the first support 116 is coupled to and makes contact with the inner tube 142 such that the first support 116 is prevented from moving. The first support 116 also supports the circuit board 118 such that the circuit board 118 is electrically connected to the power source 114. At least a portion of the second support 120 is coupled to, and makes contact with, the inner tube 142 such that the second support 120 is prevented from moving. The second support 120 allows portions of the rotary switch 122 to make an electrical connection with the circuit board 118.

The electronic flare 100 includes an actuation mechanism. The actuation mechanism includes a rotary switch 122, the activation block 126, a first washer 138, a second washer 140, and the external switch portion 107 of the twist switch 106. The rotary switch 122 is also supported by the second support 120, allowing the rotary switch 122 to rotate while maintaining the same horizontal orientation. An upper portion of the rotary switch 122 is a rotary member 148 that extends through an aperture of the first washer 138 and into a recess 158 of the activation block 126 such that the rotary switch 122 is operably connected to the activation block 126. The second washer 140 surrounds a bottom portion of the activation block 126 to assist with rotation. A coupling member 146 (i.e. tab or post) extends through an aperture of the inner tube 142 and couples the activation block 126 to the external switch portion 107. Accordingly, various components of the actuation mechanism couple the external switch portion 107 to the rotary switch 122.

FIGS. 5A-5E shows the activation block 126 from various views. The rotary member 148 has a roughly cylindrical body with a flat edge on one part of the cylinder. The recess 158 has a non-cylindrical shape with flat edge that receives an end of the rotary member 148 that is shaped similarly. Accordingly, rotation of the activation block 126 rotates the rotary switch 122. Rotating the external switch portion 107 rotates the rotary member 148 and the activation block 126, which in turn rotates rotary switch 122. Rotating the rotary switch 122 allows a portion of the rotary switch 122 to come into contact with certain portions of the circuit board 118.

To allow the external switch portion 107 to rotate around the inner tube 142, the inner tube 142 has a groove or slot partially around its circumference to provide coupling member 146 with a path that it may travel along. A first location dowel 124 and a second location dowel 125 couple the external switch portion 107 to the inner tube 142. Inner tube 142 has a corresponding groove or slot to accommodate both the first location dowel 124 and the second location dowel 125, allowing the external switch portion 107 to rotate partially around inner tube 142.

Referring now to FIGS. 6A-6C, the light module 108 includes the top end cap 102. At least one light source 136 is electrically connected to the top end cap 102. In this example embodiment, the light module 108 contains a plurality of light sources 136, with one light source 136 being located along each side of the hexagonal-shaped end cap 102. The light sources 136 can be light emitting diodes (LEDs) or any other suitable electronic device that emits light. A light source containment tube 144 surrounds the plurality of light sources 136. The light source containment tube 144 has an inner portion 144*b* and an outer portion 144*c*. The inner portion 144*b* includes apertures 144*a* that are sized to allow light from the light sources 136 to pass therethrough. The outer portion 144*c* covers the inner portion 144*b*, thereby covering the apertures 144*a*. The inner portion 144*b*, outer portion 144*c*, and apertures 144*a* may collectively be referred to as the light source containment tube 144. The light source containment tube 144 is coupled to the top end cap 102 and the light source contact holder 112. In this example embodiment, the light source containment tube 144 has a coupling aperture 144*d* for receiving a screw 144*p* that engages a grooved aperture 102*a* in the top end cap 102. The light source contact holder 112 has a central post with a channel 112*c* and the end cap 102 has an aligned channel 102*c*. A pin 102*p* is placed through the channel 112*c* of the end cap 102 and engages the channel 112*c* of the light source contact holder 112 in a friction fit manner to hold these two pieces together. As shown in FIGS. 2E, 3 and 4, the inner tube 142 has a threaded portion 142*t* to match the grooves 112*g* of the light source contact holder 112, allowing the light source contact holder 112 to be removably coupled to the inner tube 142.

An inner light source contact ring 132 and an outer light source contact ring 134 are held by the light source contact holder 112. The inner light source contact ring 132 and the outer light source contact ring 134 both have vertical shafts that engage and are electrically connected to the at least one light source 136 and a dual contact pin 130. The dual contact pin 130 is in electrical connection with a contact pin 128 (see FIG. 2D). The contact pin 128 is in electrical connection with the activation block 126 and therefore is in electrical connection with rotary switch 122. The inner tube 142 is used to close the circuit loop.

The light source containment tube 144 of the electronic flare 100 is transparent, allowing light emitted from the plurality of light sources 136 to project outwardly therethrough. In some embodiments, the plurality of light source 136 may generate light in one or more colours. For example, the plurality of light source 136 may generate a single color of light including, but not limited to, green, blue, red, yellow, or orange. In another example, the plurality of light source 136 may comprise a plurality of colours, wherein at least one of the plurality of light sources 136 is a different colour than another of the plurality of light sources 136. In another example, the plurality of light source 136 may emit infrared light.

In some embodiments, the light source containment tube 144 of the electronic flare 100 is tinted such that light emitted from the plurality of light sources 136 may project outwardly therethrough. In some embodiments, the light source containment tube 144 may be tinted in one or more colours. For example, the light source containment tube 144 may be tinted with a single colour including, but not limited to, green, blue, red, yellow, or orange. In another example, the light source containment tube 144 may be tinted in a plurality of colours. In such embodiments, one side of the light source containment tube 144 may be tinted a first colour, and another side of the light source containment tube 144 may be tinted a second colour, thereby allowing two colours of light to be emitted from the electronic flare 100.

The light module 108 is removably attachable with the electronic flare 100. The modular nature of the light module 108 allows a user to quickly and easily replace the light module 108. The user may need to replace the light module 108 if any of the at least one light sources 136 malfunction or burns out. In other situations, a user may wish to change the colour of light emitted by the electronic flare 100, and may do so by swapping out one light module for another light module with a different coloured light source.

When the external switch portion 107 is rotated in a first direction, the rotary switch 122 comes into electrical contact with the circuit board 118. This rotation completes the electrical circuit between the power source 114 and the at least light source 136. Once this electrical circuit is complete, the at least one light source 136 is activated and emits light. When the external switch portion 107 is rotated in a second direction that is opposite the first direction, the electrical contact between the circuit board 118 and the rotary switch 122 is broken, thereby breaking the electrical connection to the at least one light source 136. When the electrical connection to the at least one light source 136 is broken, the at least one light source 136 is deactivated and no longer emits light.

The rotary switch 122 has a plurality of electrical rotary contacts 150, 152, and 154 (see FIG. 2E). In other embodiments, there is at least one electrical rotary contact including one, two or more than four electrical rotary contacts. For each electrical rotary contact, there is an associated mode of operation for the electronic flare 100 where the electronic flare 100 emits different light patterns. This can be implemented by each rotary contact making contact with a different input on the circuit board 118 to therefore provide different inputs to a processor or controller on the circuit board 118 which accesses a given location of memory that corresponds to the lighting mode where accessed memory location includes data on the light pattern to be emitted during the lighting mode.

For example, starting from a deactivated mode where there is no electrical contact between the circuit board 118 and the rotary switch 122, the twist switch 106 is rotated in a first direction, connecting the first electrical rotary contact 150 to the circuit board 118. This first connection allows the electronic flare 100 to enter a first lighting mode. When the twist switch 106 is further rotated in the first direction, the second electrical rotary contact 152 connects with the circuit board 118, thereby allowing the electronic flare 100 to enter a second lighting mode. Further rotating the external switch portion 107 in the first direction connects the third electrical rotary contact 154 with the circuit board 118, thereby allowing the electronic flare 100 to enter a third lighting mode. When in the third lighting mode, the external switch portion 107 may be rotated in a second direction allowing the second electrical rotary contact 152 to connect with the circuit board 118, which reenters the electronic flare 100 into the second lighting mode. Further rotation in the second direction allows the electronic flare 100 to enter the first lighting mode, and further rotation still allows the electronic flare 100 to enter into a deactivated mode where no light is emitted by the electronic flare 100.

In some embodiments, when the electronic flare 100 is in the deactivated mode, the external switch portion 107 may be rotated in either a clockwise or a counterclockwise direction to reach the next lighting mode. For example, when in the deactivated mode, if the external switch portion 107 is rotated in a clockwise direction, the electronic flare 100 may enter the first lighting mode, but rotation in a counterclockwise direction may enter the electronic flare 100 into the third lighting mode when there are three rotary switch contacts.

There may be as many lighting modes as electrical rotary contacts 150, 152 and 154 on the rotary switch 122. Each lighting mode allows the electronic flare 100 to emit light in a different manner. Some common modes may include, but are not limited to, at least one of an off lighting mode (where no rotary electrical contacts are electrically connected to the circuit board 118, a steady-on lighting mode where light is constantly emitted by the electronic flare 100, a strobe lighting mode where the light is emitted in pulses, a Morse code lighting mode where the light is emitted according to a predefined Morse code message such as help, and a user programmable lighting mode.

In some embodiments, each lighting mode allows the electronic flare 100 to emit light at a different intensity level (i.e. a different amount of brightness). For example, a first lighting mode may emit light at 100% brightness, a second lighting mode may emit light at 75% brightness, and a third lighting mode may emit light at 50% brightness. In some embodiments, each lighting mode may allow the electronic flare 100 to emit light in a different colour. For example, a first lighting mode may emit a first colour of light, a second lighting mode may emit a second colour of light, and a third lighting mode may emit a third colour of light. The colour of light may include, but is not limited to, green, blue, red, yellow, or orange. In some of these embodiments, the different light intensities and/or different colors may be user programmable through software. Alternatively, in other embodiments these different lighting modes will be preprogrammed at the time of manufacture.

The off lighting mode will typically be when the electronic flare 100 is in the deactivated mode. However, between lighting modes, the rotary switch 122 may lose electrical contact with the circuit board 118, such that no light is emitted by the electronic flare 100 but this intermediary state is not considered the off lighting mode.

The steady-on lighting mode allows the electronic flare 100 to continuously emit light through its at least one light source 136. The strobe lighting mode allows the electronic flare 100 to emit light through its at least one light source 136 in some alternating flashing pattern, which may be set to be, for example, a rapid flashing pattern, a slow flashing pattern, or some combination of a rapid and slow flashing pattern.

The Morse code lighting mode allows the electronic flare 100 to emit light through its at least one light source 136 according to some predefined Morse code pattern. For example, this Morse code pattern may be in the form of the letters 'SOS' in Morse code, which is a universal distress signal. SOS in Morse code is denoted as . . . - - - . . ., or short short short, long long long, short short short. Accordingly, when the Morse code lighting mode is programmed to emit the Morse code for SOS, the at least one light source 136 will emit light in the pattern of three long flashes, three rapid flashes, and three long flashes. This pattern will then repeat itself. It should be understood that the Morse code lighting mode may be predefined to emit light in other Morse code patterns, and is not limited to the SOS Morse code pattern.

The user programmable lighting mode allows the user of the electronic flare 100 to preprogram a customized pattern. In the user programmable lighting mode, the at least one light source 136 will emit flashes of light in a pattern chosen by the user. For example, this mode may allow the user to preprogram the electronic flare 100 to emit light in a different Morse code pattern. In an embodiment with a user programmable mode, the electronic flare 100 may have a user input connected to the circuit board 118. The user input may accept a data transfer device, such as a USB cable, that allows the user to connect to the circuit board 118 to a computer (not shown) that has an electronic flare application program and that allows the user to define and transfer a lighting code to the circuit board 118. In some embodiments, the electronic flare 100 may include a communication unit (not shown) having a wireless receiver for receiving the user input. For example, the electronic flare 100 may include one or more of a Bluetooth receiver, a Wifi receiver, or a Near Field Communication receiver in the communication unit for receiving user input. The user input may wirelessly communicate with a computer or mobile device by way of an electronic flare software application that allows the user to define and transfer a lighting code to the circuit board 118. Alternatively, in some embodiments, the lighting modes of the electronic flare 100 may be pre-programmed.

In another embodiment with a user programmable lighting mode, a data transfer device may not be required. In such an embodiment, there may be a user input integrated into the electronic flare 100. For example, there may be a button on the side of the electronic flare 100 that allows the user to enter a programming mode in which a lighting sequence can be entered by pressing the button in a particular pattern. This lighting sequence is then stored in memory on the circuit board 118. After programming, when a user manipulates the twist switch 106 to enter the electronic flare 100 into the user programmable lighting mode, the at least one light source 136 emits light in a pattern that was specified by the user.

In some embodiments, the electronic flare 100 may have a mount for supporting the electronic flare 100 in an upright or angled position. Some examples of mounts include, but are not limited to, at least one of a flotation mount, a spike mount, a hinged mount, a rigid mount, a bracketed mount, a magnetic mount, a hooked mount, and a buckled mount.

Figure 7:
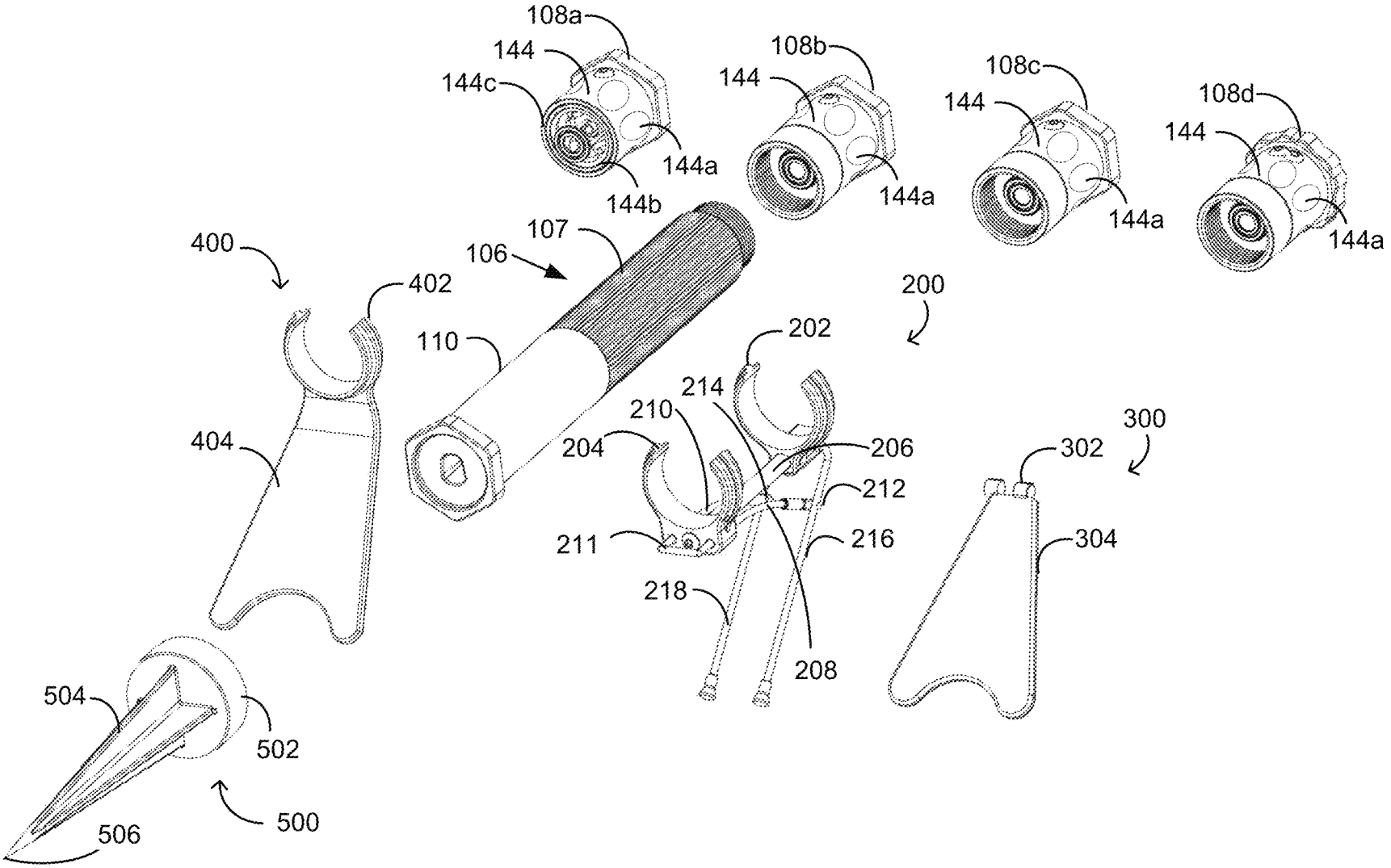
FIG. 7 shows various example embodiments of mounts and LED modules for the electronic flare of FIG. 1.

Referring now to FIG. 7, shown therein is an example of a mount 200. Mount 200 may be attached to electronic flare 100 by a first clamp 202 and a second clamp 204. The clamps 202 and 204 are semi-circular with a gap to receive the electronic flare 100. The clamps 202 and 204 are connected by a longitudinal member 206. The longitudinal member 206 may also be referred to as rod 206. To attach the mount 200 to the electronic flare 100, each end of the semi-circle of clamps 202 and 204 may be pulled apart, allowing the electronic flare 100 to be placed against the inside of the clamps 202 and 204. Releasing the clamps 202 and 204 allows the clamps to tighten around the outer tube 110 of the electronic flare 100.

The mount 200 has a first end and a second end. The first and second ends have clamps 204 and 202 respectively that have a U or horseshoe shape with tips that are flexible such that they can wrap around the body of the electronic flare 100, i.e. at the twist switch 106 and the outer tube 110, to releasably attach the mount 200 to the electronic flare 100. The mount 200 has a first arm 208 and a second arm 210 that are flexible. Arms 208 and 210 each have a proximal end near the clamp 204 and a distal end opposite the proximal end. Proximal ends of arms 208 and 210 are coupled to the first end of the mount 200. In this case, there are channels through the first end of the mount 200 which the proximal ends of the arms 208 and 210 extend through such that they are joined by a cross member 211. In this example embodiment, the arms 208 and 210 and the cross member 211 are formed by a single piece of material. The distal ends of arms 208 and 210 are coupled to gripping members 212 and 214, respectively. The gripping members 212 and 214 are pivotally coupled to a portion of legs 216 and 218, respectively. Proximal ends of the legs 216 and 218 are coupled to the second end of the mount 200. Distal ends of the legs 216 and 218 have caps for engaging with a surface upon which the electronic flare 100 is to stand. The longitudinal member 206 of mount 200 is coupled between the first and second ends of the mount 200 using a screw, a pin or another fastening element.

When the legs 216 and 218 are in a first position that is furthest away from the longitudinal member 206, the electronic flare 100 is in a substantially upright position. When the legs 216 and 218 are moved to a second position that is closer to the longitudinal member 206, the electronic flare 100 is in an angled position. When the legs 216 and 218 are moved to be substantially adjacent to the longitudinal member 206, the mount 200 is in a closed position and is not used to hold the electronic flare 100.

In some embodiments, the gripping members 212 and 214 may be rigidly connected to the legs 216 and 218. In such an embodiment, the arms 208 and 210 may be slidably connected to the mount 200. Pushing on cross-member 211 allows the arms 208 and 210 to slide through the mount 200. Due to the rigid connection between the gripping members 212, 214, and the legs 216, 218, when a force is applied to the cross-member 211, arms 208 and 210 slide through mount 200, and the legs 216 and 218 extend outwardly from the mount 200. When the legs 216 and 218 are extended, the mount 200 allows the electronic flare 100 to rest on a surface in a desired orientation.

Still referring to FIG. 7, shown therein is another embodiment of a mount 300 with a support 304. Mount 300 has a hinge 302 that allows the mount 300 to couple to a clamp similar to clamp 202 or clamp 204, but with a hinge receptor. Once the mount 300 is coupled to the electronic flare 100 by placing the clamp 204 around a portion of the cylindrical body of the electronic flare 100, perhaps at the external switch portion 107 of the twist switch 106 or the outer tube 110, the support 304 maintains the electronic flare 100 at an angle when the electronic flare 100 and the bottom of the mount 300 are placed on a surface. Moving the hinge 302 changes the angle of the electronic flare 100 relative to the surface that it is placed on.

In some embodiments, there is a mount that does not have a pivot means to change the angle at which the electronic flare 100 is mounted on a surface. For example, FIG. 7 also shows a mount 400 with a clamp 402. The clamp 402 operates in the same manner as clamps 202 and 204 described above. The mount 300 has a support 404 that is connected to and is integral with the clamp 402. When the mount 400 is coupled to the electronic flare 100, the support 404 maintains the electronic flare 100 at an angle when the electronic flare 100 is placed on a surface.

In some embodiments, the electronic flare 100 has a mount that does not require a clamp. For example, FIG. 7 also shows a mount 500. The mount 500 has a coupling member 502 that couples the mount 500 to the bottom end cap 104 of the electronic flare 100. The coupling member 502 has a shape that is complimentary to the shape of the bottom end cap 104, which allows the coupling member 502 to be releasably connected to the electronic flare 100 by a friction fit. The mount 500 has at least one web 504 that narrows in width from the coupling member 502 to an end point 506. The mount 500 resembles a spike. When the mount 500 is coupled to the electronic flare 100, the end point 506 may be inserted into a soft surface such as grass or mud. The mount 500 maintains the electronic flare 100 in a substantially upright position when the mount 500 is inserted into a surface. The mount 500 allows the electronic flare 100 to be dropped from a distance, such as from a helicopter, into a surface below that the user wishes to mark with the electronic flare 100. In this case, the electronic flare 100 may be dropped after a particular lighting mode is selected by the user.

In some embodiments, the mount 500 does not have a spike, but instead has a flat plate that attaches to the bottom of end cap 104. The flat plate has a larger surface area than the end cap 104. Such a plate allows the electronic flare 100 to be placed on a flat surface and support the electronic flare 100 in a substantially upright position. The plate may have any shape that is capable of supporting the electronic flare 100, including, but not limited to, a square, circle, or triangle.

In another embodiment, the electronic flare 100 may have a flotation mount. The flotation mount may couple to the electronic flare 100. When placed in water, the flotation mount may keep the electronic flare 100 in a substantially upright position such that the light module 108 is kept above water.

In some embodiments, the flotation mount is an external mount that is attached to the outer tube 110 of the electronic flare 100. Due to the weight of the power source 114 at the bottom of the electronic flare 100, the flotation mount allows the electronic flare 100 to float in a substantially upright position, with the light source containment tube 144 residing above the water level. In other embodiments, the flotation mount is an internal mount located within the electronic flare 100. The internal flotation mount may compensate for the weight distribution of the electronic flare 100, keeping the electronic flare 100 in a substantially upright position and allowing the light source containment tube 144 to reside above the water level.

The method of attaching the mount to the electronic flare need not be limited to clamps. Any attachment mechanism may be used including, but not limited to, straps, Velcro, screws, or magnets, for example.

In some embodiments, a mount may replace the bottom end cap. For example, similar to the mount 500, a spiked mount may directly couple to the inner tube 142 and outer tube 110 of the electronic flare, rather than coupling to the bottom end cap. In such embodiments, a bottom end cap is not needed to seal the bottom of the electronic flare.

In some embodiments, a mount may have a buckle that receives a strap. The strap may be of such a length that it may be wrapped around a tree or a post while supporting the electronic flare. Alternatively, in some embodiments, a mount may have a buckle that clips to a receiving buckle attached to another object. For example, the mount may be clipped to a backpack or a jacket.

In some embodiments, a mount may have hooks that enable the electronic flare to be hung from an object. For example, the mount may have one or more small hooks that may be hung from a backpack or a jacket, supporting the electronic flare.

Figure 8B:
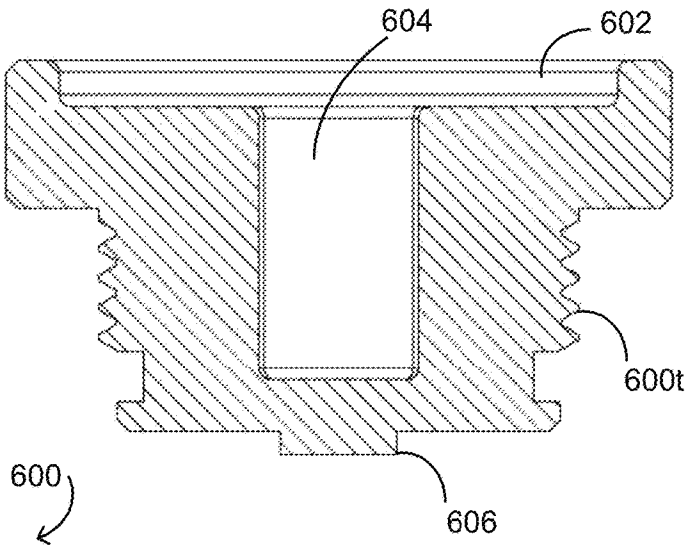
FIGS. 8A-8C show a side view, a sectional view and a bottom view of the bottom end cap of the electronic flare of FIG. 1.
Figure 8C:
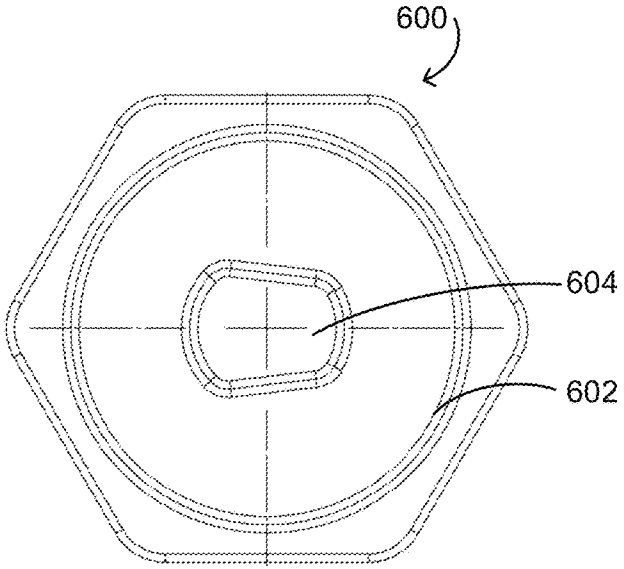
Figure 8A:
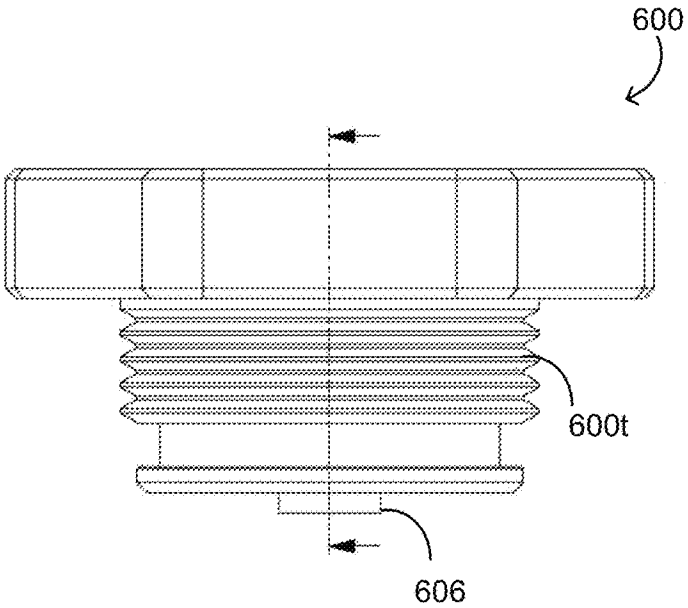

As described above, in some embodiments, the power source may be at least one rechargeable battery. In such embodiments, the bottom end cap 104 may be a charging mount with electrical contacts that allow the rechargeable battery to be electrically connected to a charger. The charging mount may use any technology capable of recharging the power source of the electronic flare 100. For example, FIGS. 8A-8C show an example embodiment of a bottom end cap 600 with an accommodation 602, a recess 604 and a battery holder. The accommodation 602 and the recess 604 may accept a charging bracket or prong (not shown). The at least one rechargeable battery rests on the battery holder 606 of the charging mount 104. An insert of the charging bracket makes electrical contact with the at least one rechargeable battery. When the charging bracket is coupled to a power supply and the electronic flare, the at least one rechargeable battery may be charged. The power supply to the charging bracket may be any suitable power source such as, but not limited to, a power outlet, a USB power connection, a charging port in a vehicle, or a separate charger, for example.

Accordingly, the at least one rechargeable battery may be charged through direct electrical contact. Alternatively in other embodiments, the at least one rechargeable battery may be charged through wireless induction, or both direct electrical contact and wireless induction.

In some embodiments, a charging station may be used to charge multiple electronic flares. The charging station may be capable of charging multiple electronic flares at the same time. The charging station may charge the electronic flares using direct electrical contact, wireless induction, or both. This charging station may be used in emergency service vehicles as they may use several electronic flares at a time and always need them to be charged. The charging station may come with mounting brackets to be attached to a wall or within a vehicle such as a firetruck or tow truck.

In some embodiments, a mount may be used to attach an electronic flare to another surface or object. For example, the mount may have a corresponding mount receptor or bracket with one end that is releasably couplable to the bottom end cap 104 of the electronic flare 100 and another end that is fixable to some other surface. The mount receptor may be fixed to any surface such as, but not limited to, the side of a boat, a car, and a construction sign, for example. The end of the mount receptor that is fixable to the other surface may be magnetic or it may have an adhesive with a non-stick top layer that can be peeled off to allow the mount to be adhered to a surface.

In some embodiments, the electronic flare may have tactile feedback. The tactile feedback may be a click or a vibration felt by a user as they actuate the external switch portion 107 to select a lighting mode of operation for the electronic flare. As each lighting mode is entered, there is tactile feedback for the user notifying them that a new lighting mode has been entered. For example, referring now to FIGS. 9A-9E, shown therein is an example embodiment of a first support 700 that includes a first accommodation 702 and a second accommodation 704. In this case, turning the external switch portion 107 of the electronic flare may provide tactile feedback via the first support 700 of a circuit board 718. The first support 700 is somewhat similar to the support 116 for supporting the circuit board 118. However, the first support 700 has two semi-circular holes passing through, due to a unibody embodiment of the electronic flare, while first support 116 only has a single hole passing through it.

Figure 9C:
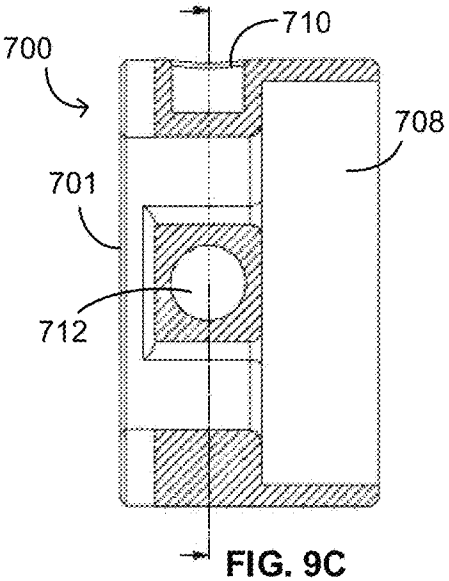
FIG. 9C shows a sectional view of the support of FIG. 9B.
Figure 9B:
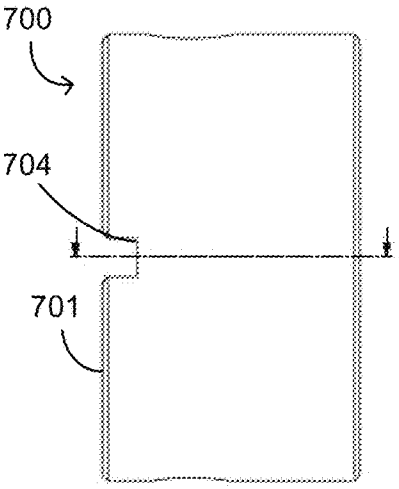
FIG. 9B shows a side view of the support of FIG. 9A.
Figure 9A:
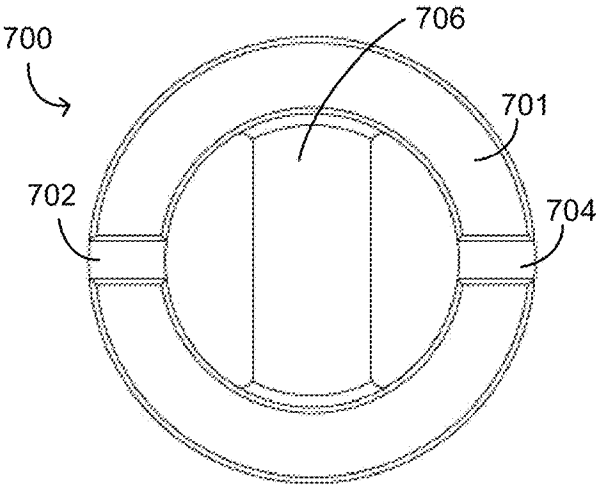
FIG. 9A shows a top view of an example support with a tactile feedback mechanism in accordance with the teachings herein.
Figure 9E:
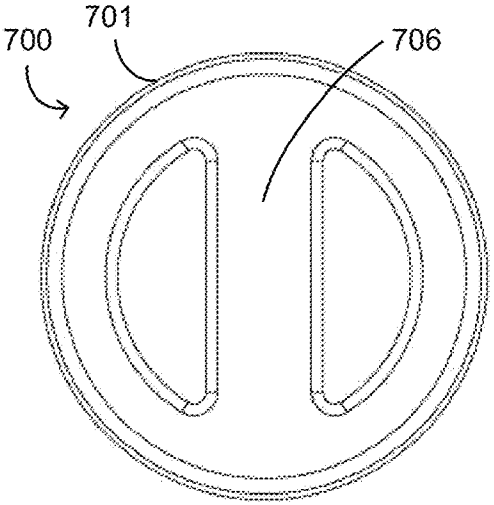
FIG. 9E shows a bottom view of the support of FIG. 9A.
Figure 9D:
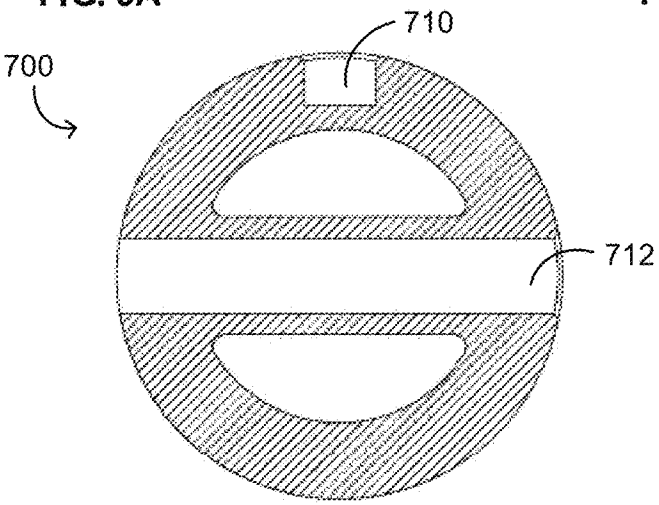
FIG. 9D shows a sectional view of the support of FIG. 9C.
Figure 10:
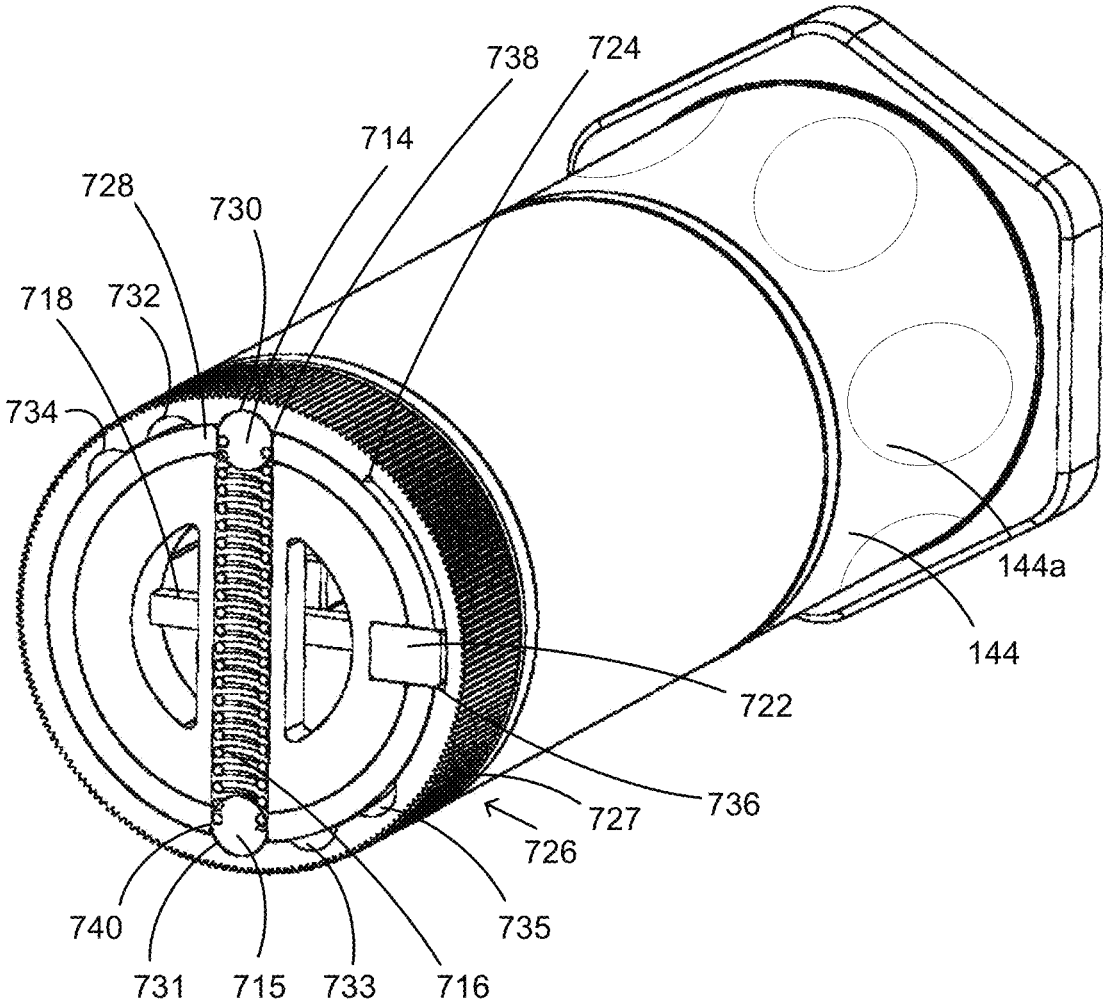
FIG. 10 shows a perspective bottom sectional view of a support with a tactile feedback mechanism, where the support is located within the body of an electronic flare in accordance with the teachings herein.

The accommodations 702 and 704 provide recesses along a first outer ring 701 in the first support 700 that is adjacent to and supports a bottom surface of the circuit board 718. The first support 700 has a central plate 706 that extends across the diameter of the first outer ring 701, connecting at opposite sides of an inner edge of the first outer ring 701. The central plate 706 is adjacent to and supports a bottom surface of the circuit board 718. FIG. 9C shows a cross-sectional side view of the support 700. A power source recess 708 provides an accommodation for the power source 114, as previously described. A locator recess 710 provides an accommodation for a location dowel 722, as shown in FIG. 10. The location dowel 722 couples the first support 700 to an external switch portion 727 and an inner tube 728. The external switch portion 727 is an external part of the twist switch 726 and is rotatable around the inner tube 728. When the external switch portion 727 is rotated, a path 724 allows the location dowel 722 to rotate around the inside of the external switch portion 727. An inner tube locator recess 736 accommodates the location dowel 722. Rotating the external switch portion 727 does not rotate the inner tube 728. The path 724 provides a maximum degree of rotation of the external switch portion 727 since the location dowel 722 will stop the rotation of the external switch portion 727 when the location dowel 722 reaches either end of path 724.

Referring now to FIG. 10, a groove 712 in the first support 700 provides accommodation for two ball bearings 714, 715, and a spring 716. The spring 716 is located between the two ball bearings 714 and 715. The spring 716 exerts an outward radial force on the ball bearings 714 and 715 such that the ball bearings 714 and 715 are pushed through a first inner tube bearing hole 738 and a second inner tube bearing hole 740, respectively, against the inside of twist switch 726. The external switch portion 727 has at least four slots 730, 731, 732, and 733 that accommodate the ball bearings 714 and 715. Each of the four slots 730-734 correspond to one of the lighting modes described earlier.

The ball bearings 714 and 715 are pushed by the spring 716 into slots 730 and 731. When the external switch portion 727 is rotated, the ball bearings 714 and 715 are pushed by the external switch portion 727 out of the slots 730 and 731. Continued rotation of the external switch portion 727 pushes the ball bearings 714 and 715 into slots 732 and 733. The slots 730, 731, 732, and 733 correspond to the different lighting modes of the electronic flare 100 as described above. For example, when the electronic flare 100 is deactivated, the ball bearings 714 and 715 may reside in slots 730 and 731 respectively. When the external switch portion 727 is rotated and the ball bearings 714 and 715 move to slots 732 and 733, respectively, and the electronic flare 100 enters the first lighting mode.

In some embodiments, the electronic flare has more than one lighting mode. As seen in FIG. 10, there is a second pair of slots 734 and 735 that correspond to a second lighting mode of the electronic flare as described above. For each lighting mode of the electronic flare, there are two corresponding slots to accommodate the ball bearings 714 and 715.

When the ball bearings 714 and 715 enter a new pair of slots, the spring 716 pushes the bearings 714 and 715 against the twist switch 726. Due to the force exerted by the spring 716, when the bearings 714 and 715 contact the external switch portion 727, the user will feel a click or vibration.

It should be noted that the tactile feedback mechanism may include any device capable of exerting force on one or more objects that contact the twist switch as it is actuated. For example, instead of a spring, the tactile mechanism may include a rubber insert that is compressed by the ball bearings as the external switch portion 727 is rotated. In other embodiments, the spring may be made of a metal leaf spring. In other embodiments, there may be a metal rod with a spring on both ends, which contacts the ball bearings and forces the ball bearings against the inside wall of the twist switch.

In some embodiments, only a single ball bearing may be used. In such embodiments, the first support may have a wall on one side of the groove, and an opening for receiving a ball bearing on the other. The force-exerting device, such as a spring, pushes on the wall with one end and pushes on the ball bearing with the other end to ensure the ball bearing contacts the inside wall of the twist switch. Accordingly, in such embodiments there is one groove for each lighting mode.

The tactile feedback mechanism may also be implemented such that it adds a physical resistance to the twisting motion of the twist switch when it is actuated to place the electronic flare into a particular lighting mode. In such embodiments, in order to rotate the twist switch 726, a user must use sufficient rotational force such that, for example, the ball bearings 714 and 715 compress the spring 716 as the ball bearings 714 and 715 move out of their respective slots. For example, the spring 716 may have a larger spring constant. Once the ball bearings 714 and 715 have compressed the spring 716, the external switch portion 727 is free to rotate to a new position. In other words, the tactile feedback mechanism may act as a temporary locking mechanism to hold the external switch portion 727 in place, because a certain amount of force is required to compress the spring 716. The tactile feedback mechanism therefore may make it more difficult for a user to switch between modes accidentally, as a greater amount of force is required to move the ball bearings between slots.

Figure 11:
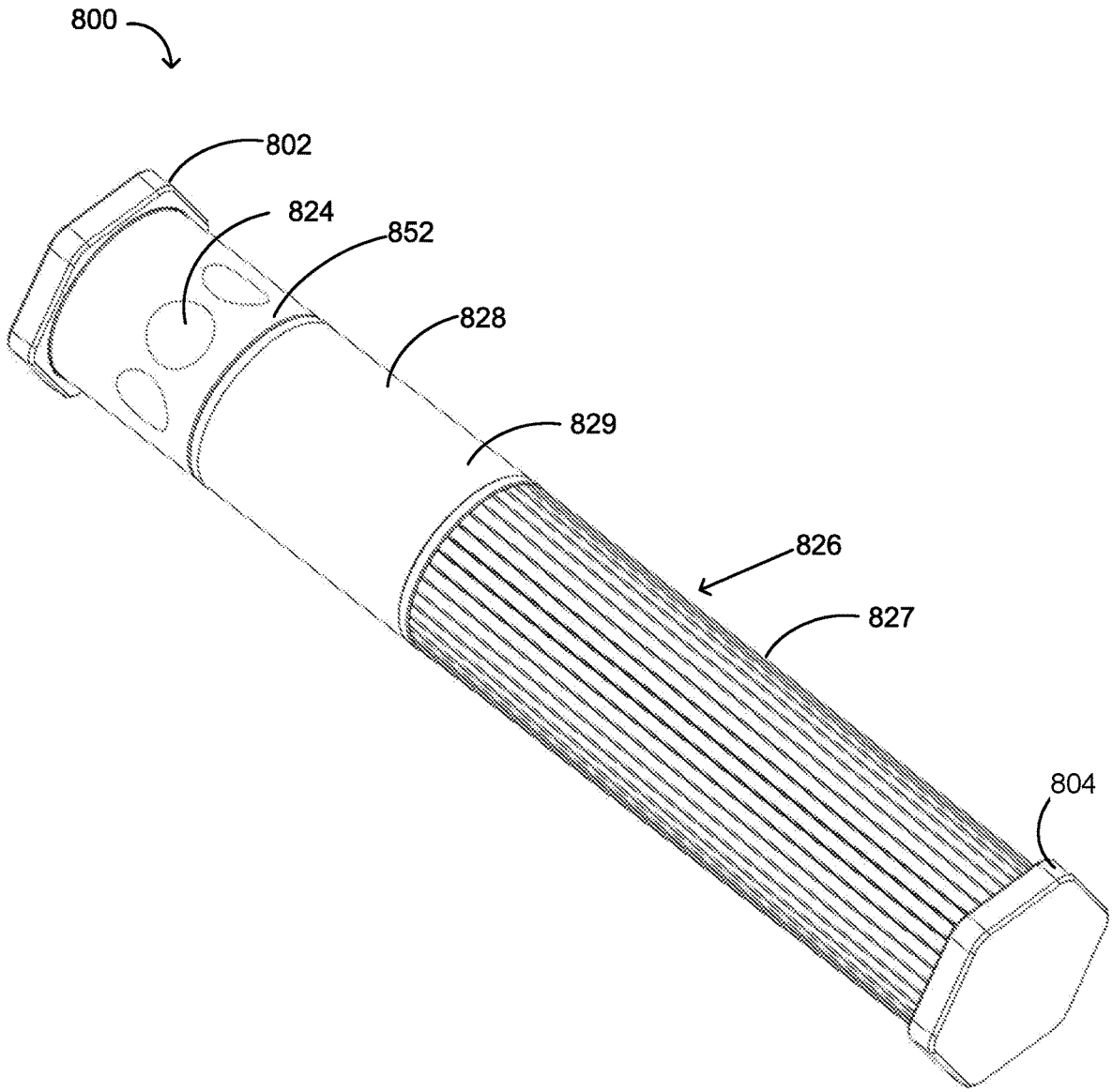
FIG. 11 shows a perspective view of an example of an alternative embodiment of an electronic flare in accordance with another aspect of the teachings herein.
Figure 12A:
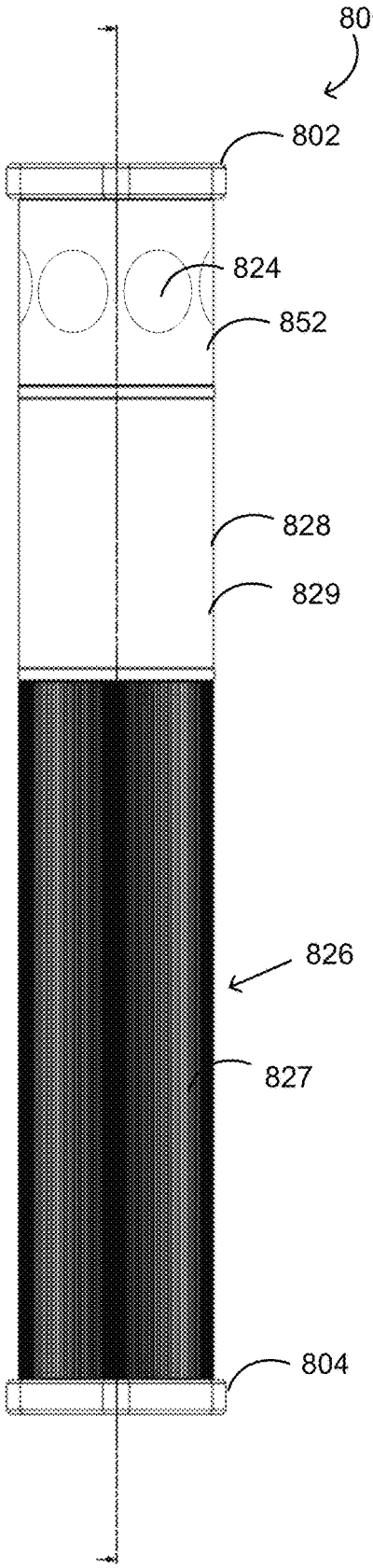
FIGS. 12A and 12B show a side view and a sectional view, respectively, of the electronic flare of FIG. 11.
Figure 12B:
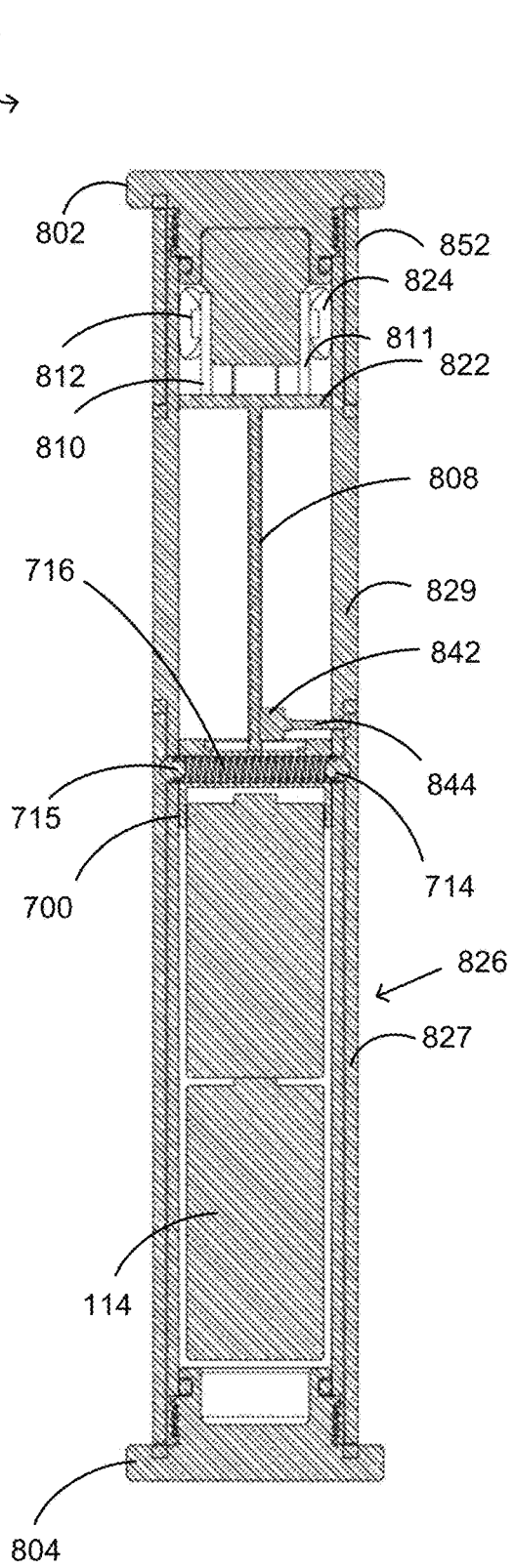

In some embodiments, the electronic flare may have a light module that is removable from the electronic flare while in other embodiments the light module will be removable. Referring now to FIGS. 11, 12A, and 12B, shown therein is an example of an alternative embodiment of an electronic flare 800. The electronic flare 800 has a top end cap 802 and a bottom end cap 804, similar to the top end cap 102 and bottom end cap 104 of the electronic flare 100 described previously. The bottom end cap 804 is removably coupled to a first end of an inner tube 828 and an external switch portion 827 of a twist switch 826. The top end cap 802 is removably coupled to a second end of the inner tube 828.

Figures 13A, 13B, 13C:
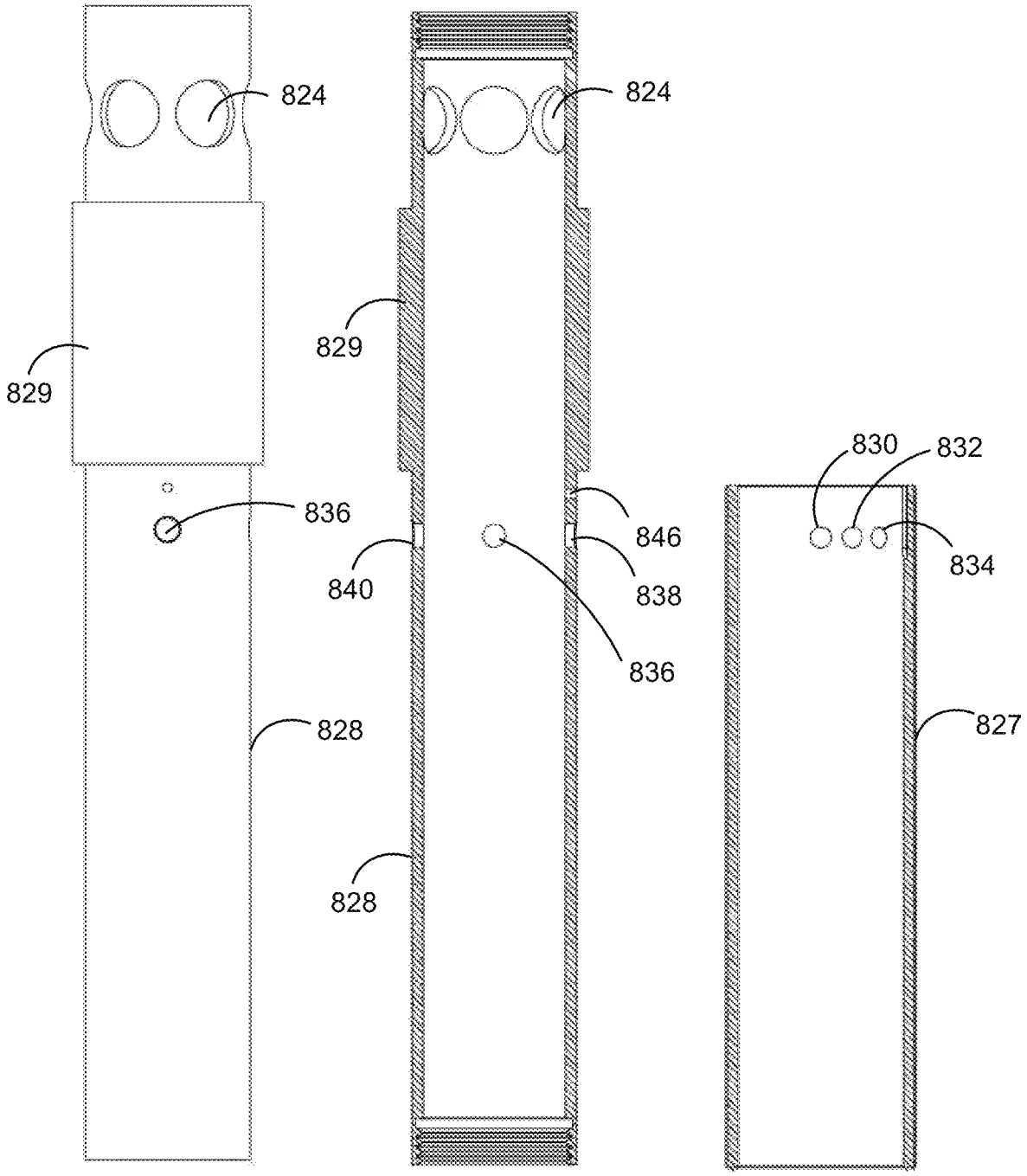
FIGS. 13A and 13B show a side view and a sectional view, respectively, of an inner tube of the electronic flare of FIG. 11.
FIG. 13C shows a side view of a twist switch of the electronic flare of FIG. 11.

Referring now to FIGS. 13A and 13B, shown therein is the inner tube 828. FIG. 13C shows the external switch portion 827. The inner tube 828 extends substantially the entire length of the electronic flare 800. The inner tube 828 is mostly cylindrical with a constant inner diameter, and a region of increased external diameter 829 between the external switch portion 827 and a light source containment tube 852. The external switch portion 827 rests on the outside of the inner tube 828 between the bottom end cap 804 and the region of increased external diameter 829 of the inner tube 828. The light source containment tube 852 rests on the outside of the inner tube 828 between the region of increased external diameter 829 of the inner tube 828 and the top end cap 802.

The top end cap 802 is removably coupled to the inner tube 828. When the bottom end cap 804 is removed, the power source 114, as described above, may be inserted into the inner tube 828. The bottom end cap 804 is then coupled to the electronic flare 800, as shown in FIGS. 11 and 12B.

The first support 700, as described previously, supports the power source 114 and a circuit board 808, while also providing a tactile feedback mechanism. The first support 700 is coupled to the external switch portion 827 and the inner tube 828 by a location dowel (not shown). The location dowel passes through an inner tube dowel hole 836 and into a path (not shown) in the external switch portion 827. The location dowel operates with the corresponding path in the same manner as the location dowel 722 and the path 724 described previously.

As described previously, the first support 700 has two ball bearings 714 and 715 and a spring 716 to provide tactile feedback to a user as the external switch portion 827 is rotated. The ball bearings 714 and 715 are forced by the spring 716 through inner tube bearing holes 838 and 840 against the inner wall of the external switch portion 827. The external switch portion 827 has at least two slots to accommodate the ball bearings 714 and 715. Referring now to FIG. 13C, shown therein are three slots, 830, 832, and 834, which accommodate ball bearing 714. The corresponding slots for ball bearing 715 are not shown. As described previously, there may be as many slot pairs as lighting modes of the electronic flare 800. Therefore, each lighting mode corresponds to a different slot pair. The tactile feedback mechanism provides tactile feedback in the same manner as described previously.

The power source 114 is electrically connectable to the first support 700, which is electrically connected to the circuit board 808. On its non-power source end, the circuit board 808 is coupled and electrically connected to a second support 822. The second support 822 is coupled and electrically connected to at least one light source support 810, which supports at least one light source 812. Each of the light source supports 810 that are used resembles a rectangular prism that extends upwards from the second support 822. The electronic flare 800 has a plurality of light sources 812 and a plurality of light source supports 810, with one light source support 810 for each light source 812. Collectively, the plurality of light sources 812 and the plurality of light source supports 810 may be referred to as the light assembly 811. The light sources can be similarly implemented as the light sources 136. When the power source 114 has sufficient charge and the electronic flare 800 is twisted out of its deactivated mode, the at least one light source 812 emits light according to the lighting mode it is in.

Figure 14:
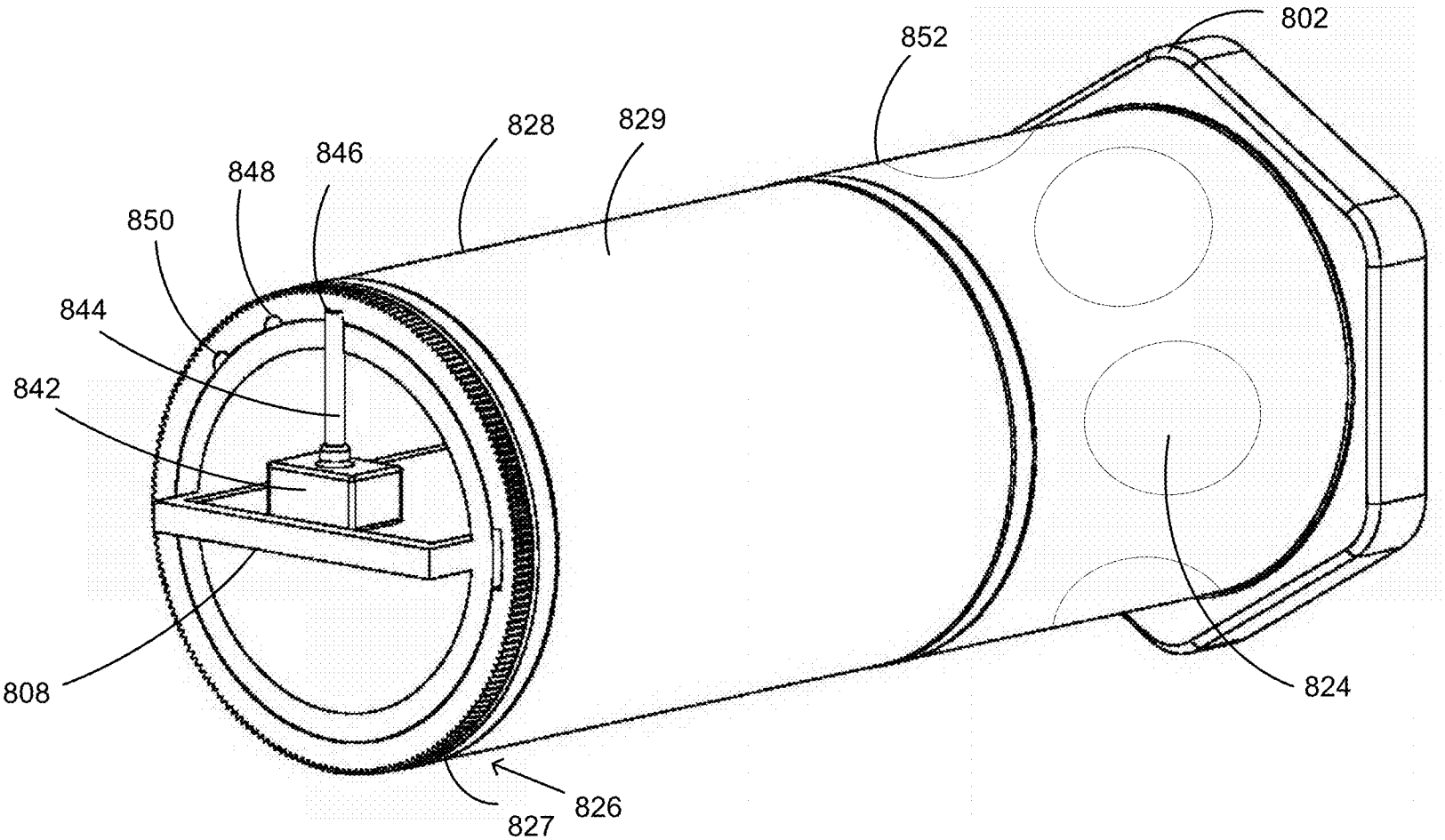
FIG. 14 shows a perspective sectional view of the electronic flare of FIG. 11.

The electronic flare 800 may have at least as many lighting modes as described for the electronic flare 100; however, the mechanism for changing lighting modes is different. Referring now to FIG. 14, shown therein is a cross-sectional perspective view of the electronic flare 800, which has a sensor 842 that is electrically connected and coupled to the circuit board 808. The external switch portion 827 has at least three markers 846, 848, and 850 which may be referred to as the internal switch portion in this embodiment. Each of the markers 846, 848, and 850 correspond to a mode of the electronic flare 800. The sensor 842 has an optical beam 844 that is used to detect one of the markers 846, 848, and 850 by detecting the reflected light from one of these markers based on which of the markers 846, 848 and 850 is aligned with the optical beam 844. Accordingly, the markers 846, 848 and 850 may include reflective material. In some embodiments, the markers 846, 848, and 850 are indents in the external switch portion 827 where the indents can reflect light and may include reflective material. The detection of one of the markers 846, 848, and 850 by the sensor 842 therefore indicates the current position of the twist switch 826, which is associated with one of the lighting modes. Therefore, the optical marker 846, 848, and 850 that is detected by the sensor 842 is used by a controller (not shown) on the circuit board 808 to select the correct lighting mode for the electronic flare 800. A user can rotate the external switch portion 827, which rotates the one of the markers 846, 848, and 850 (i.e. the internal switch portion) to be aligned with the optical beam 844, which in turn is used to change the lighting mode for the electronic flare 800. In this example embodiment, the markers 846, 848 and 850 can be considered as being the internal switch portion which is coupled to the external switch portion 827.

The light source containment tube 852 is coupled to the inner tube 828 and the top end cap 802. The light source containment tube 852 at least partially covers the at least one light source 812. To allow light emitted from the at least one light source 812 to pass outside of the inner tube 828, there is at least one light hole or aperture 824 in the inner tube 828. The inner tube 828 generally has a plurality of light holes 824 that is the same as the number of light sources 812. The light source containment tube 852 is coupled to the inner tube 828 such that light emitted from the at least one light source 812 can pass through the inner tube 828 and light source containment tube 852. Alternatively, instead of using light holes 824, transparent material, such as a transparent plastic or glass, may be used at these locations.

Figure 15A:
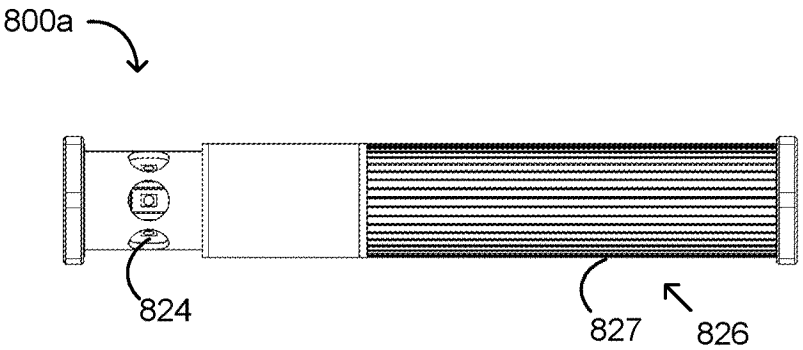
FIG. 15A shows a side view of an example of an alternative embodiment of an electronic flare in accordance with another aspect of the teachings herein.
Figure 15B:
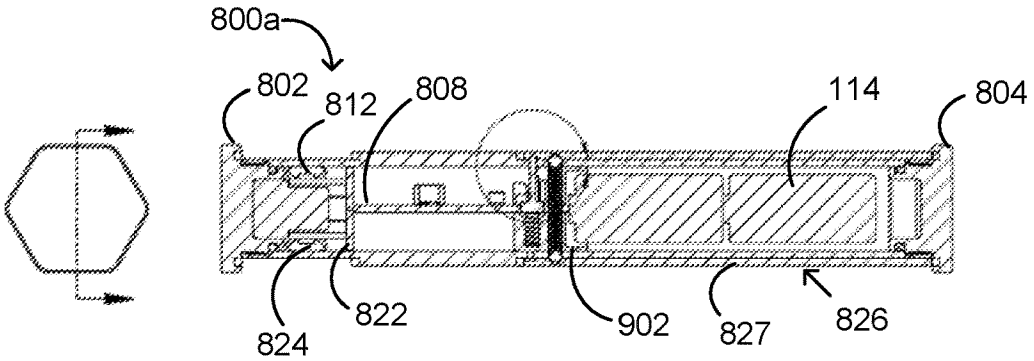
FIG. 15B shows a side sectional view of the electronic flare of FIG. 15A.
Figure 15C:
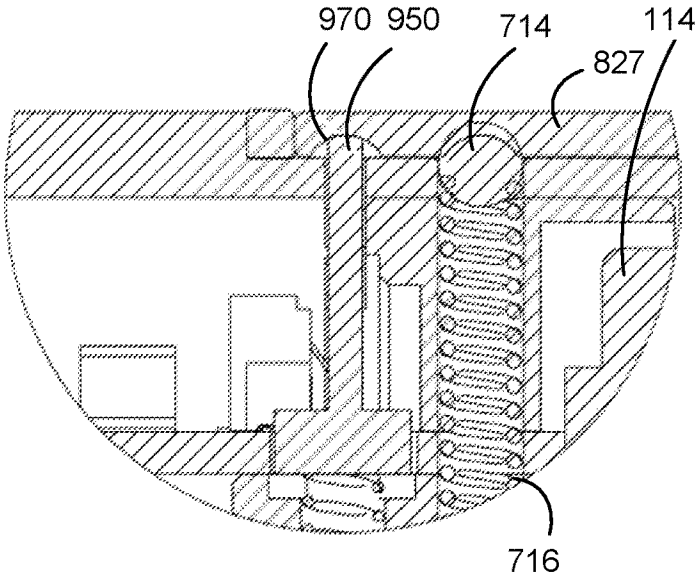
FIG. 15C shows an enlarged sectional view of the electronic flare of FIG. 15A.
Figure 16:
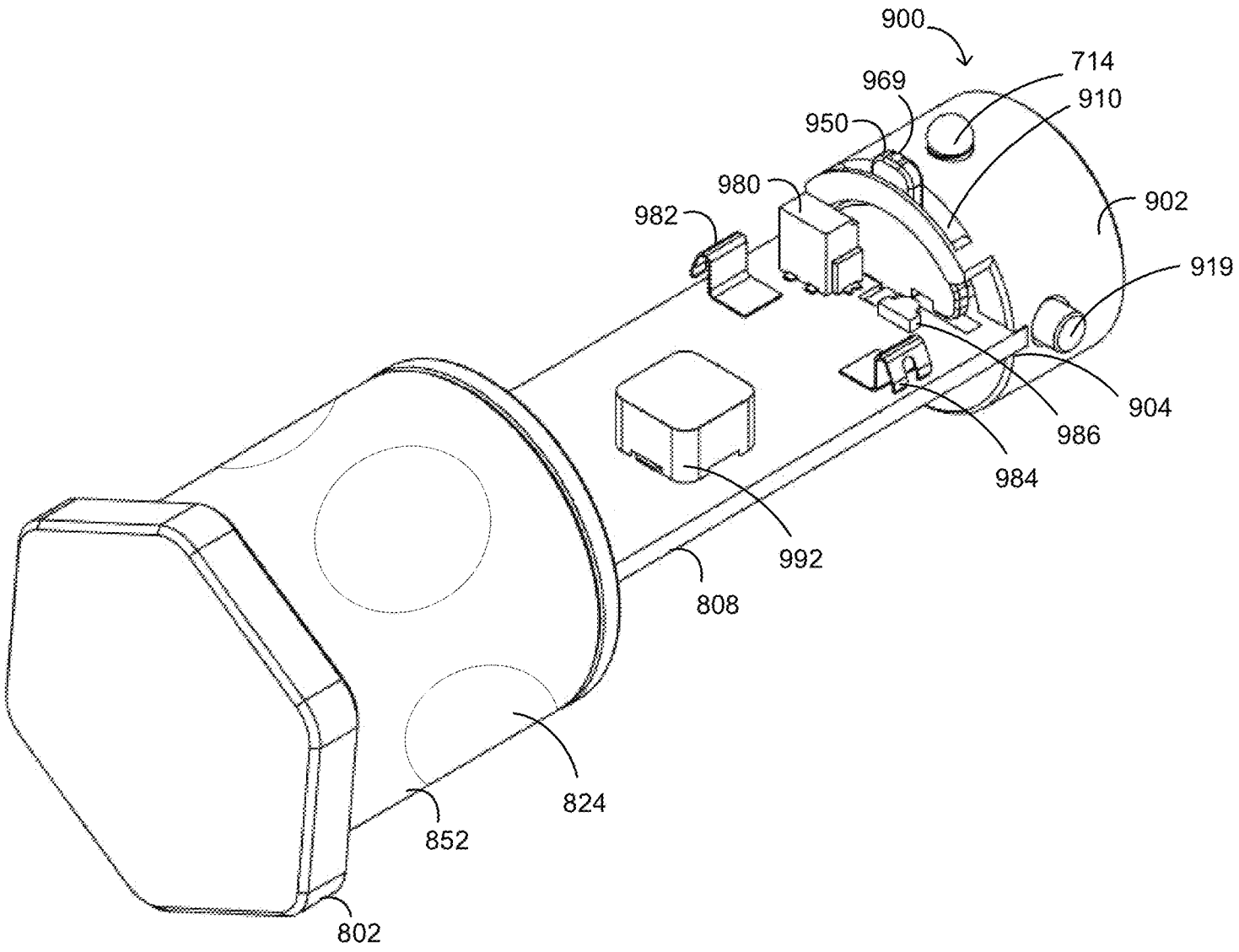
FIG. 16 shows a perspective view of a vane assembly and circuit board of the electronic flare of FIG. 15A.
Figure 17A:
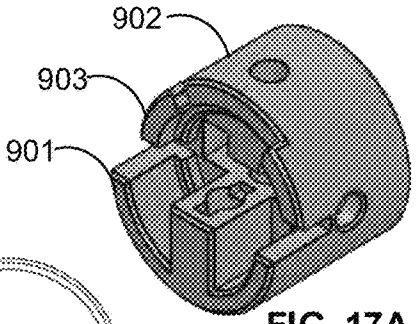
FIG. 17A shows a perspective view of an example embodiment of a vane support of the electronic flare of FIG. 15A.
Figure 17G:
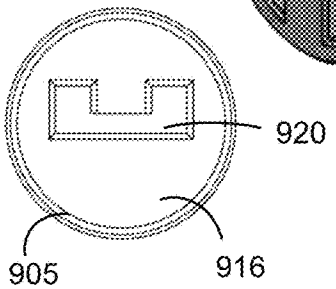
FIG. 17G shows a bottom view of the vane support of FIG. 17A.
Figure 17F:
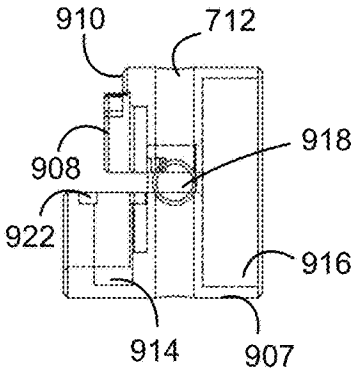
FIGS. 17C to 17F show side views of the vane support of FIG. 17A.
Figure 17C:
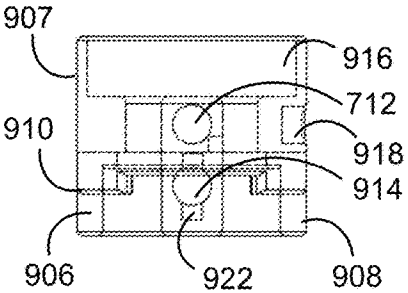
Figure 17B:
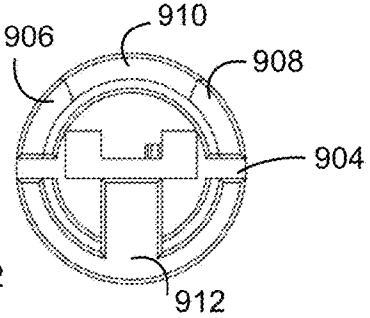
FIG. 17B shows a top view of the vane support of FIG. 17A.
Figure 17E:
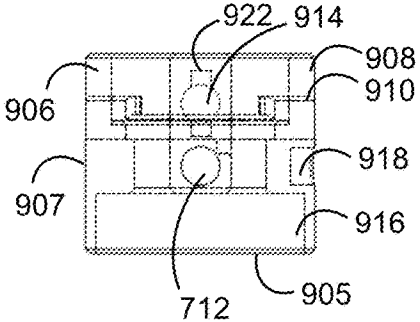
Figure 17D:
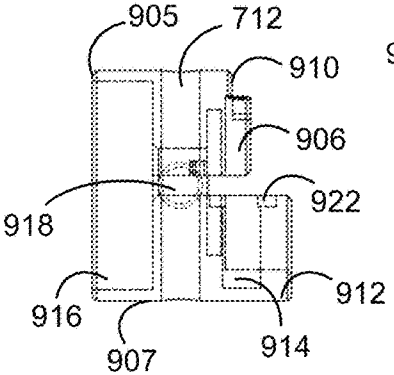
Figure 18A:
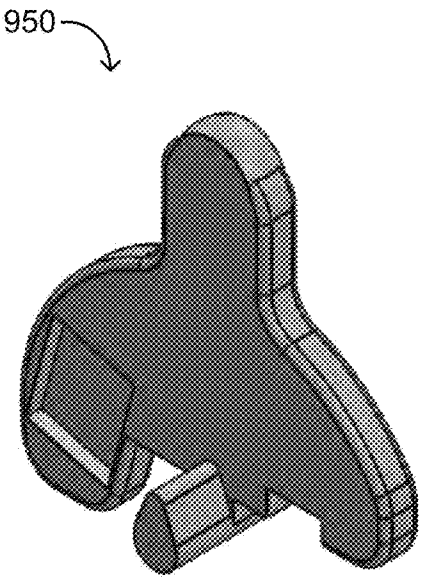
FIG. 18A shows a perspective view of an example embodiment of a vane of the vane assembly of FIG. 16.
Figure 18D:
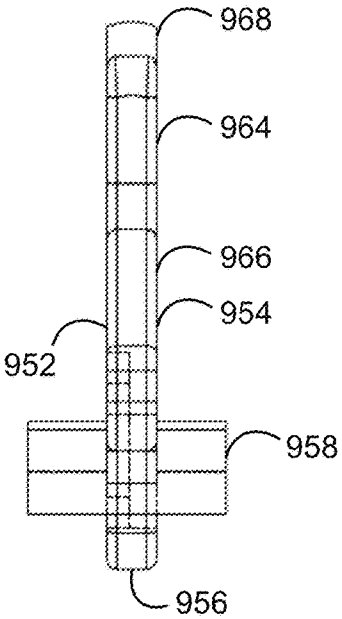
FIG. 18D shows a side view of the vane of FIG. 18A.
Figure 18C:
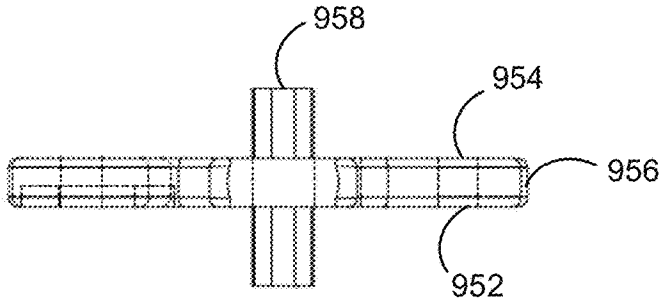
FIG. 18C shows a top view of the vane of FIG. 18A.
Figure 18B:
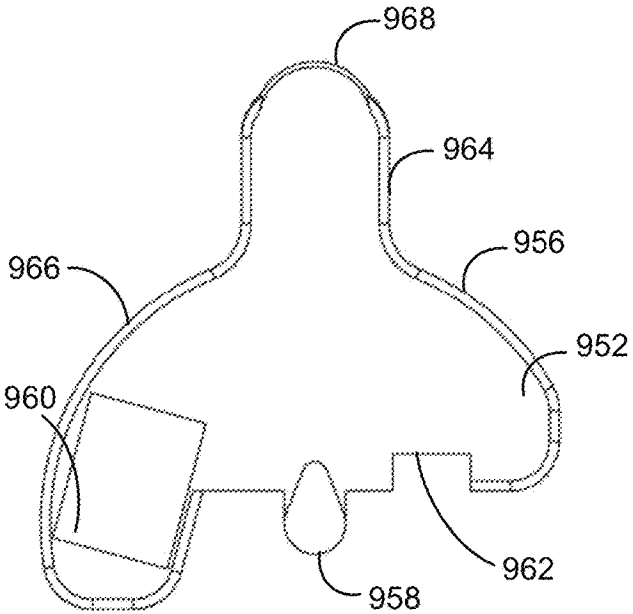
FIG. 18B shows a front view of the vane of FIG. 18A.

In some alternative embodiments, an electronic flare **800*a* which has a different mechanical assembly that may be used to change the lighting modes. For example, referring now to FIGS. 15A to 28D, shown therein is an electronic flare 800*a* with a vane assembly 900. The vane assembly 900 uses the same twist switch design as described previously, but includes a vane support 902 instead of the first support 700. Rather than using the sensor 842, the optical markers 846-850, and the optical beam 844 to change the lighting modes, the vane assembly 900 instead uses an interruptive photo sensor system as the internal switch portion. The interruptive photo sensor system makes use of a light source/phototransistor pairing, where the phototransistor determines if the light source is being interrupted by the vane assembly 900. As shown in FIGS. 15B, 15C, and 16, the vane assembly 900 includes the vane support 902 and a vane 950. The vane 950 can be considered as being an internal switch portion that is coupled to the external switch portion 827**.

Referring now to FIGS. 17A to 17G, shown therein are various views of an example embodiment of a vane support 902. The vane support 902 has a first top surface 901, a second top surface 903, and a circuit board slot 904 separating the first and second top surfaces 901 and 903. The first and second top surfaces 901 and 903 are semicircular cylindrical sections with the surface 903 having a raised portion. The circuit board slot 904 may accommodate the circuit board 808. The vane support 902 has a bottom ring 905 and a cylindrical sidewall 907 between the first and second top surfaces 901, 903 to the bottom ring 905. A recess in the sidewall 907 extends inwardly from the bottom ring 905 to form a power source support 916. The power source support 916 may be used to position the power source 114 within the vane support 902. The vane support 902 has a power source contact region 920 that may be used to electrically couple the power source 114 to the vane 950.

A recess in the second top surface 903 forms a vane tip slot 910. The vane tip slot 910 extends between a first end stop 906 and a second end stop 908 and may provide an accommodation for the vane 950. The vane support 902 includes a vane spring support 912. A vane spring slot 914 extends from an inner wall 909 of the vane spring support 912 to the sidewall 907, without passing through the sidewall 907. A vane spring 913 (see FIGS. 21A-21C) may be positioned in the vane spring slot 914. The vane spring 913 may provide an outward force on the vane 950 such that the vane 950 contacts the external switch portion 827. The vane support 902 has a vane recess 922 that extends into the vane spring slot 914 from the inner wall 909. The vane recess 922 may be used to accommodate the vane 950 and provide a region for the vane spring 913 to contact the vane 950.

Figure 22B:
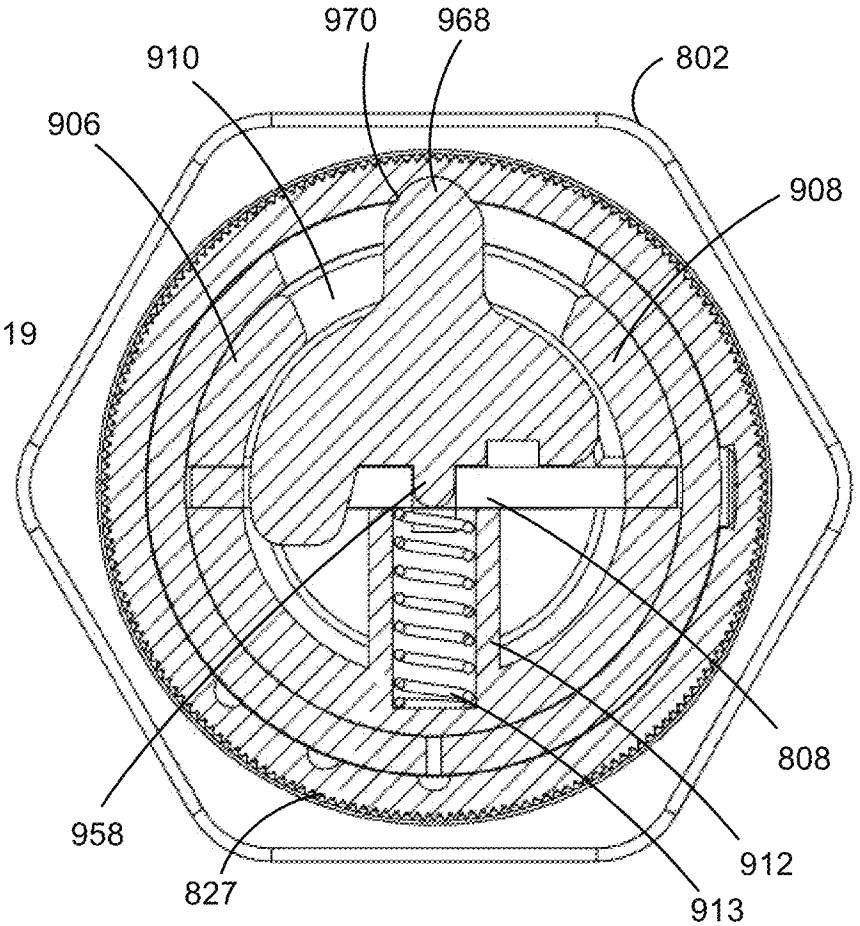
FIGS. 22A and 22B show sectional views of the vane assembly of FIG. 16 situated in the alternative embodiment of the electronic flare of FIGS. 15A-15C.
Figure 22A:
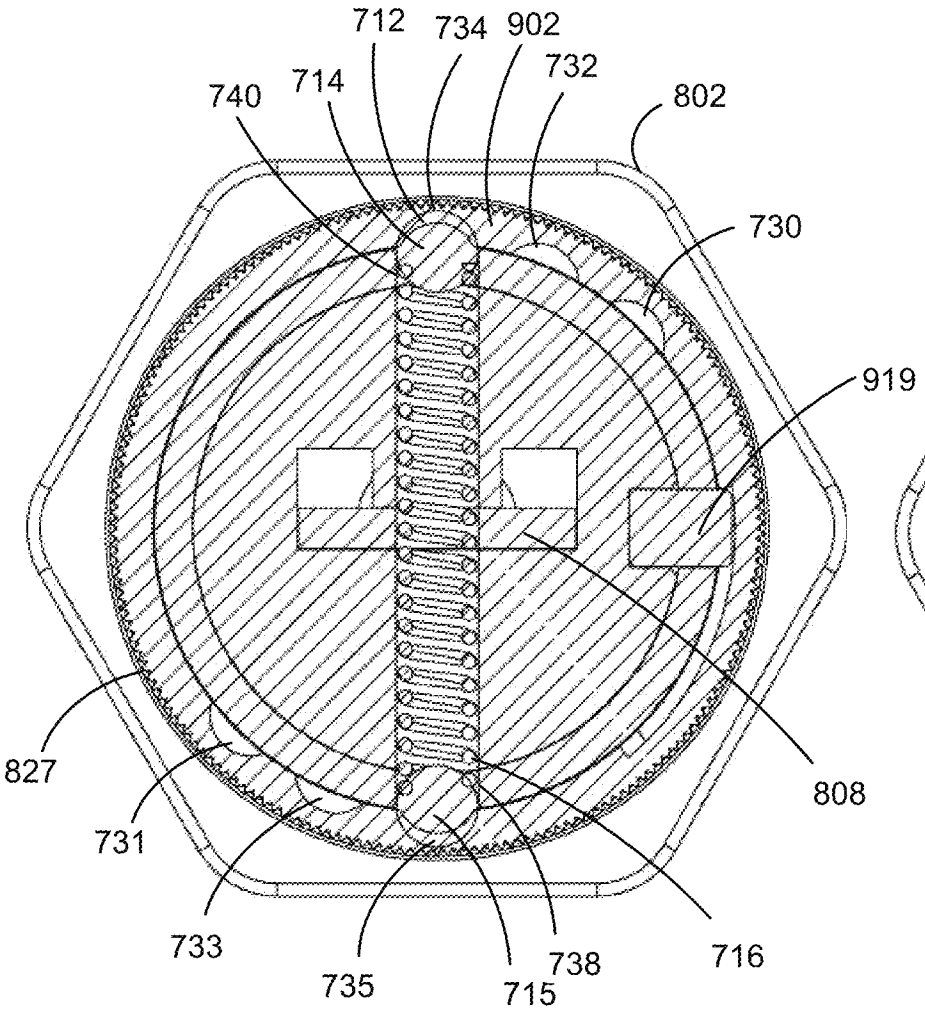

Referring now to FIGS. 22A and 22B, the vane support 902 is shown to accommodate the tactile feedback mechanism described previously. Specifically, the vane support 902 includes the groove 712 in the vane support 902, which provides accommodation for the two ball bearings 714, 715, and the spring 716 (see FIG. 22A). The spring 716 is located between the two ball bearings 714 and 715. The spring 716 exerts an outward radial force on the ball bearings 714 and 715 such that the ball bearings 714 and 715 are pushed through the first inner tube bearing hole 738 and the second inner tube bearing hole 740, respectively, against the inside of the external switch portion 827. The external switch portion 827 has at least four slots 730, 731, 732, and 733 that accommodate the ball bearings 714 and 715 and correspond to one of the lighting modes described earlier.

The sidewall 907 includes a dowel recess 918 that may accommodate a location dowel 919. The location dowel 919 may be used to couple the vane support 902 to the electronic flare 800, similar to how the location dowel 722 couples the first support 700 to the twist switch 826 and the inner tube 728.

Referring now to FIGS. 18A to 18D, shown therein is an example embodiment of a vane 950. The vane 950 has a front face 952, a rear face 954, and a sidewall 956 extending between the front face 952 and the rear face 954. The vane 950 has a vane shaft 958 that extends past both the rear face 954 and the front face 952 and may be used to couple the vane 950 to the circuit board 808 and to the vane support 902, respectively. The circuit board 808 may have a vane slot 959 for accommodating the vane shaft 958. The vane support 902 may accommodate one end of the vane shaft 958 in the vane recess 922 (see FIG. 17C). The front face 952 has a circuit board contact pad 960. The circuit board contact pad 960 allows the circuit board 808 to electrically couple to the vane 950.

Figure 19:
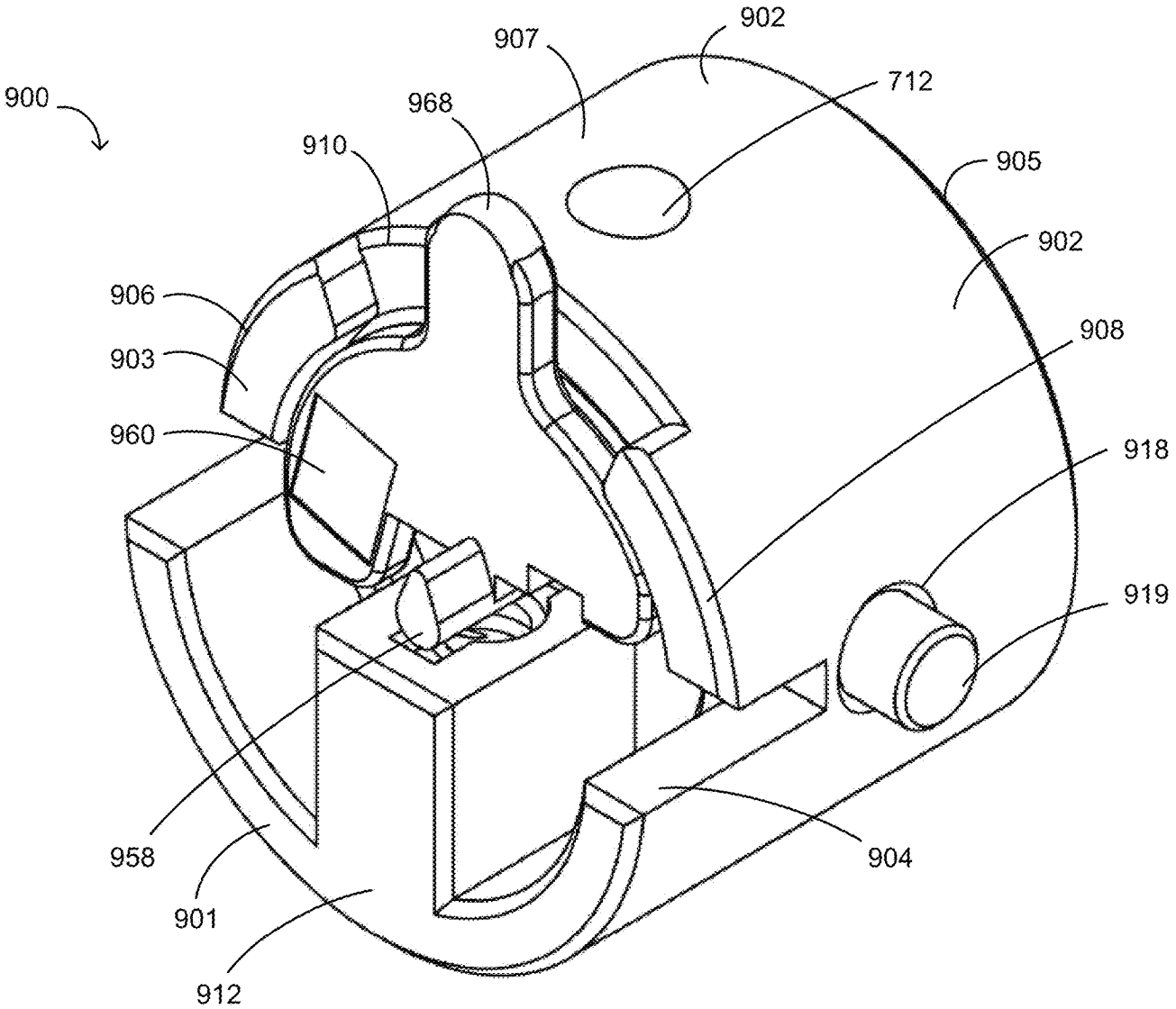
FIG. 19 shows a perspective view of the vane assembly of FIG. 16.

The vane 950 has a vane mid-portion 966 and a vane tip 964 extending outwardly from the vane mid-portion 966. The vane tip 964 has a twist switch contact region 968. The twist switch contact region 968 may be used to couple the vane tip 964 to a twist switch vane recess 970 in the external switch portion 827 such that rotation of the external switch portion 827 causes the vane 950 to rotate. In some embodiments, the twist switch contact region 968 may be a narrowed region of the vane tip 964. In other embodiments, the twist switch contact region 968 may include a small boss or bump 969 (see FIGS. 20A-20C) or a dimple. The bump 969 may be used to improve the contact between the twist switch contact region 968 and the external switch portion 827. For example, if the thickness of the external switch portion 827 is smaller, the twist switch contact region 968 may need to be smaller to ensure that the twist switch contact region 968 does not pass through the external switch portion 827. To improve the contact of the smaller twist switch contact region 968, the bump 969 may be used to increase the surface area of contact. The assembled vane assembly 900 is shown in FIG. 19. Various cross-sectional views of the vane assembly 900 are illustrated in FIGS. 20A to 20C, 21A to 21C, and 22A to 22B.

Figure 23:
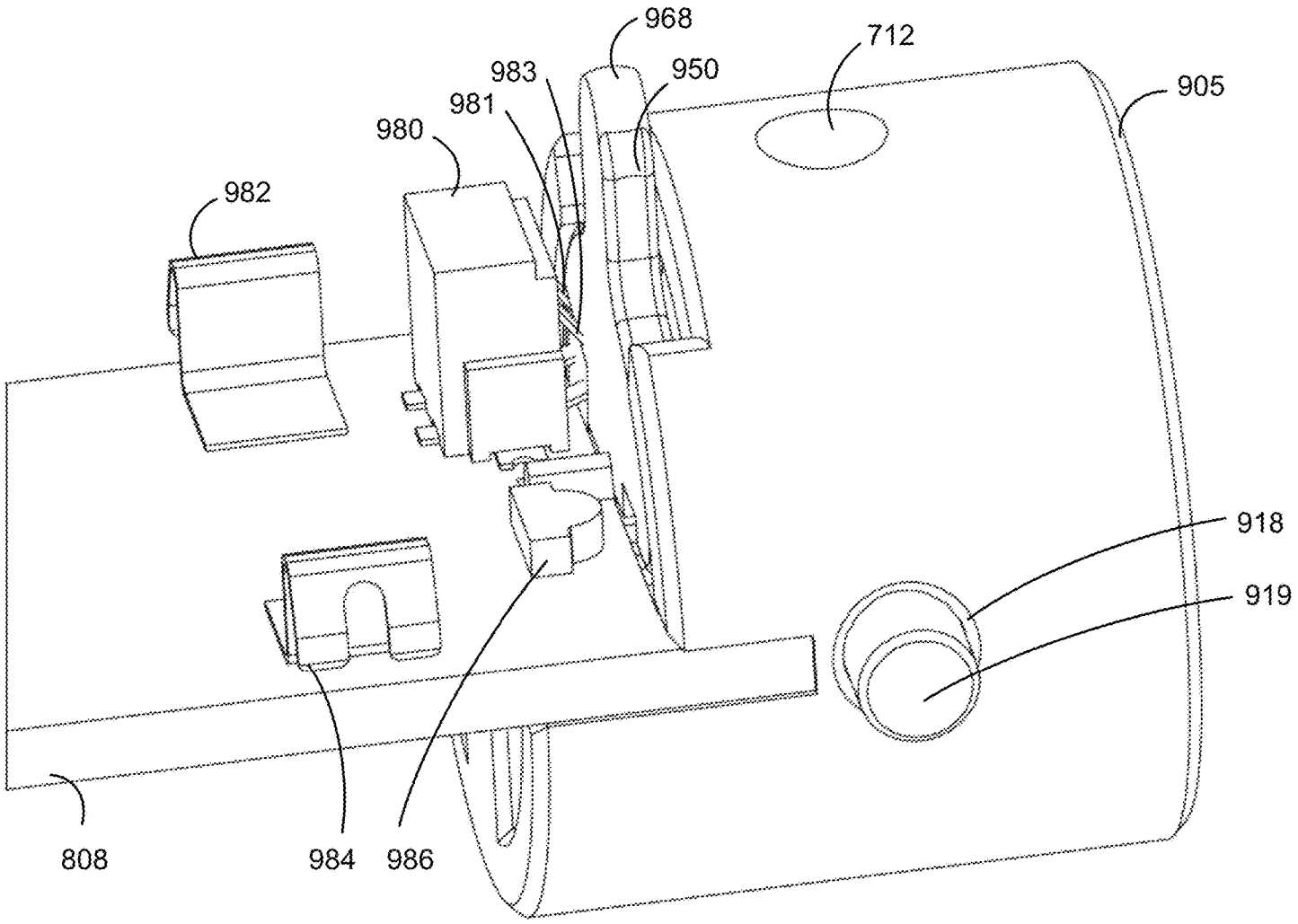
FIG. 23 shows a perspective view of a portion of the circuit board and the vane assembly of the electronic flare of FIG. 15A.
Figure 24:
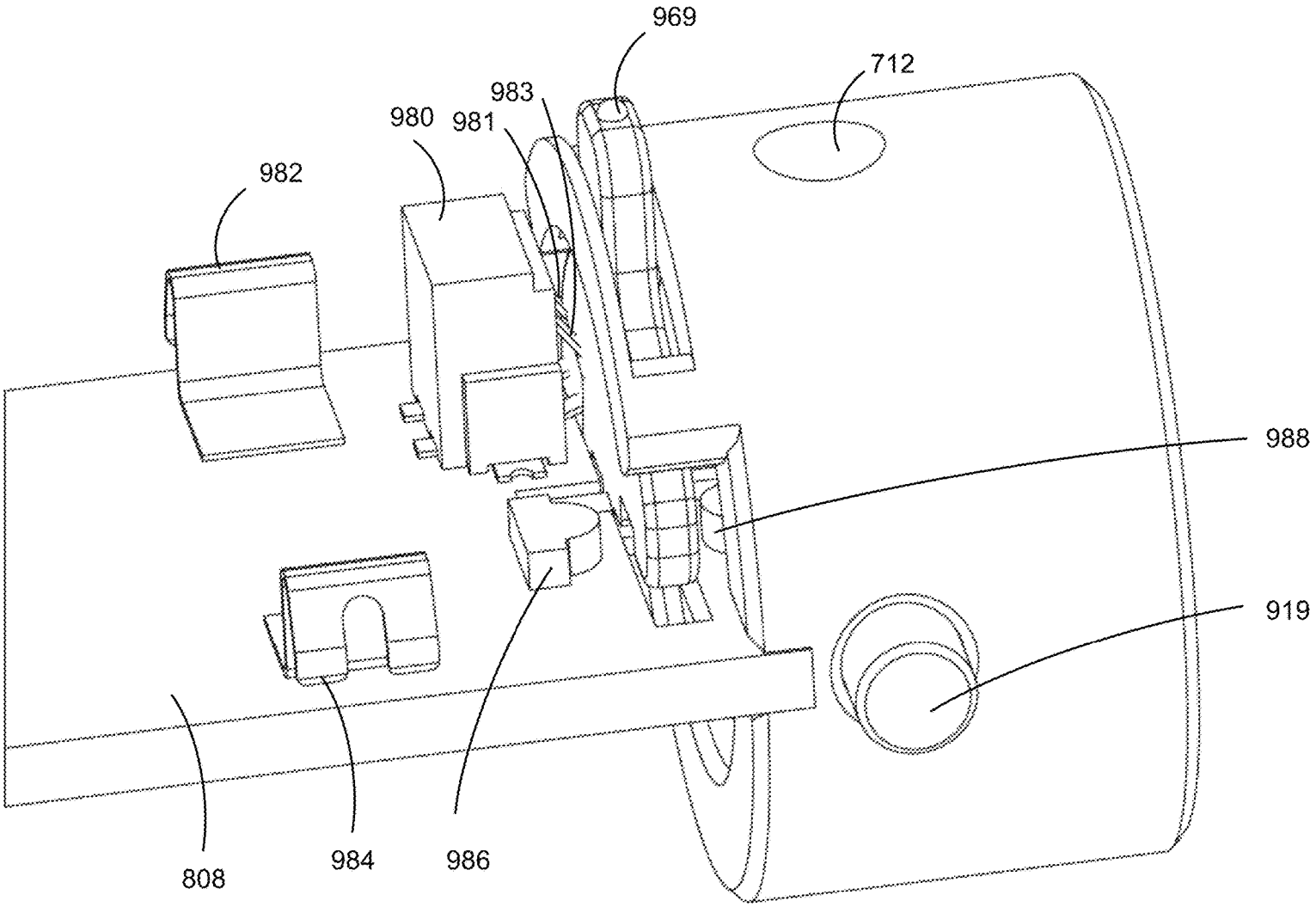
FIG. 24 shows a perspective and partial cutout view of a portion of the circuit board and the vane assembly of FIG. 23.
Figure 25:
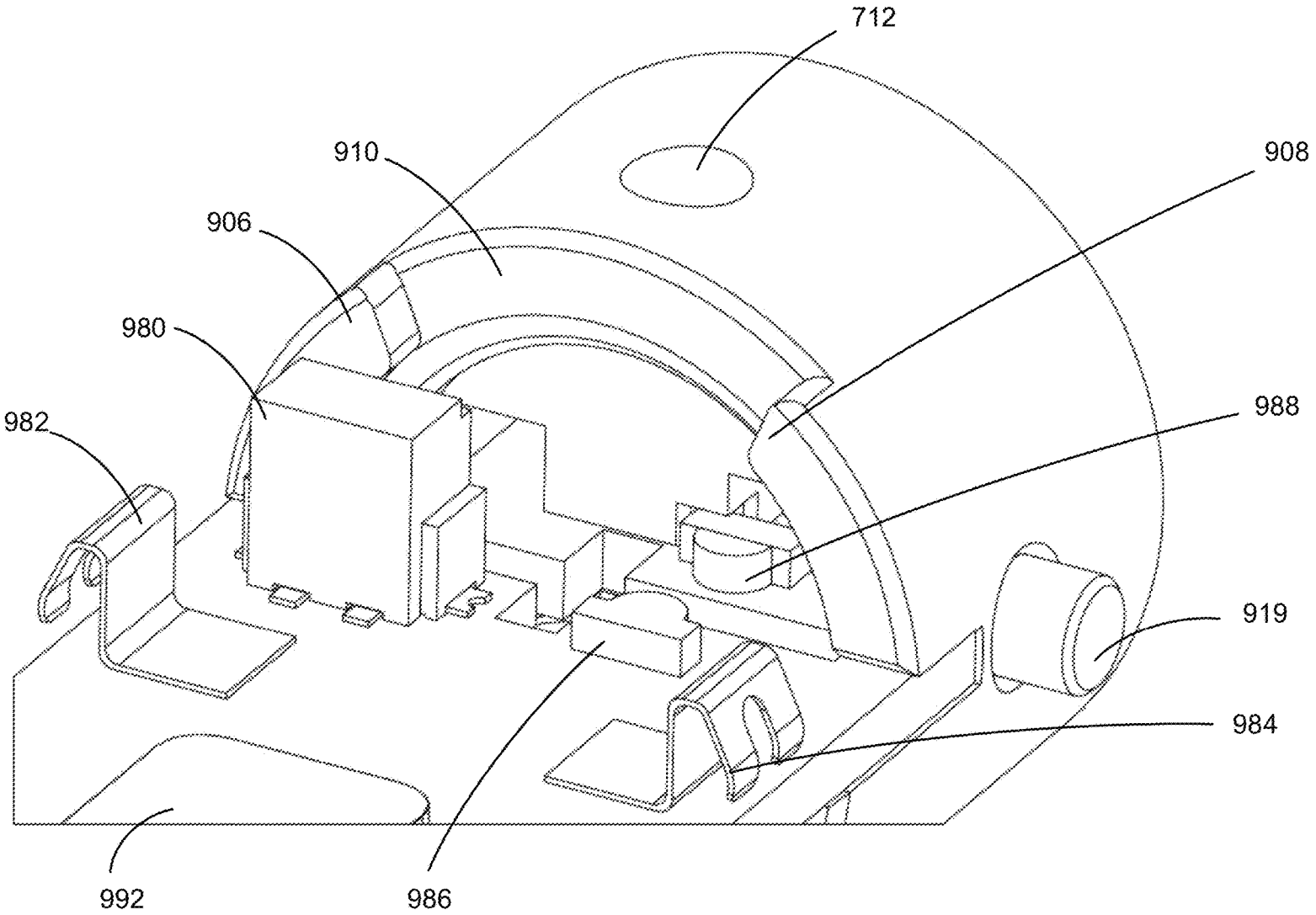
FIG. 25 shows a perspective view of a portion of the circuit board and the vane assembly of FIG. 23 with the vane removed.
Figure 26:
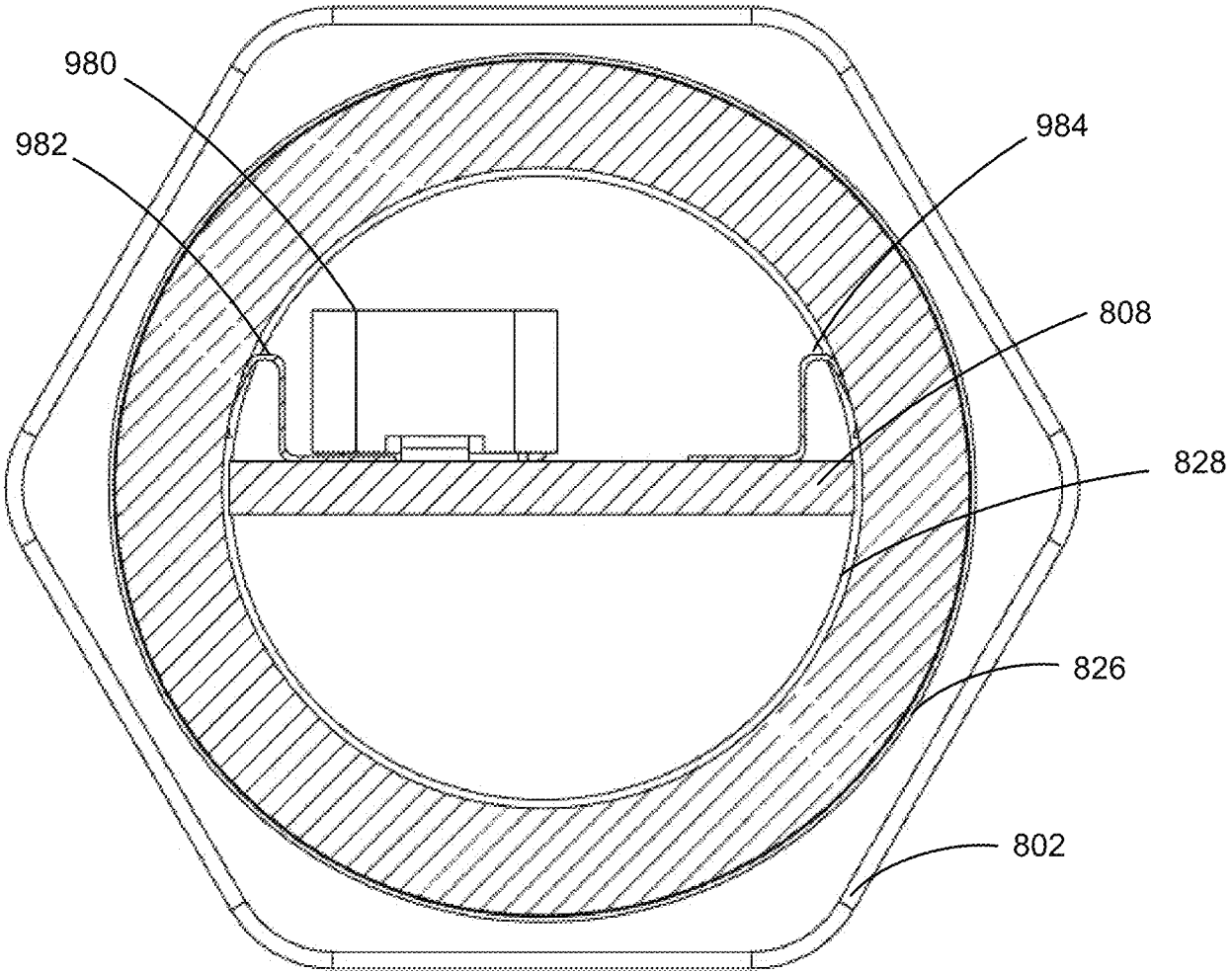
FIG. 26 shows a sectional view of the electronic flare of FIG. 15A.

Rotation of the external switch portion 827 may cause the electronic flare 800 to change lighting modes, as described above; however, the method of switching lighting modes is different with the vane assembly 900. Referring now to FIGS. 23 to 25, shown therein is an example embodiment of an interruptive photo sensor system. The circuit board 808 may be electrically coupled to the vane 950 at the circuit board contact pad 960 using a circuit board power source coupler 980. The circuit board power source coupler 980 has a first vane spring contact 981 and a second vane spring contact 983. When the vane spring contacts 981, 983 are in contact with the circuit board contact pad 960 (see FIGS. 20B-20C), electricity may flow from the power source 114, through the vane 950, through the circuit board power source coupler 980, into the circuit board 808, thereby providing power to the circuit board. To complete the circuit with the power source 114, a first inner tube contact 982 and a second inner tube contact 984 couple to the inner tube 828, as shown in FIG. 26. The inner tube contacts 982 and 984 may be spring contact that are biased towards the inner tube 828, to improve the electrical contact with the inner tube 828. Power from the power source 114 may connect to the circuit board 808 through a diode (not shown). Connecting through a diode may protect the circuit board 808 from damage in the event that the power source is incorrectly inserted.

Figure 20C:
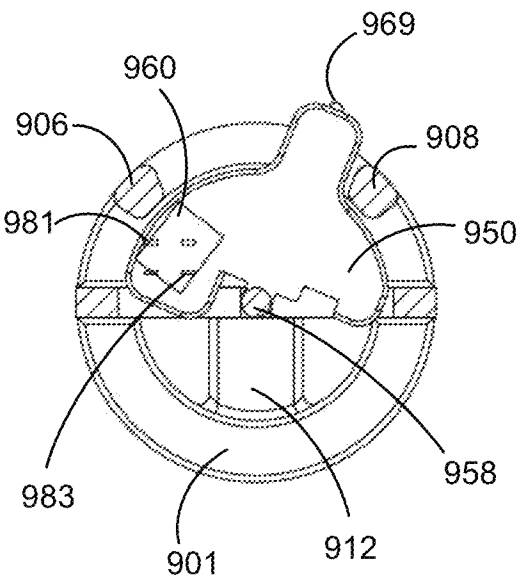
FIGS. 20A to 20C show top views of the vane assembly of FIG. 16 with the vane in different positions.
Figure 20B:
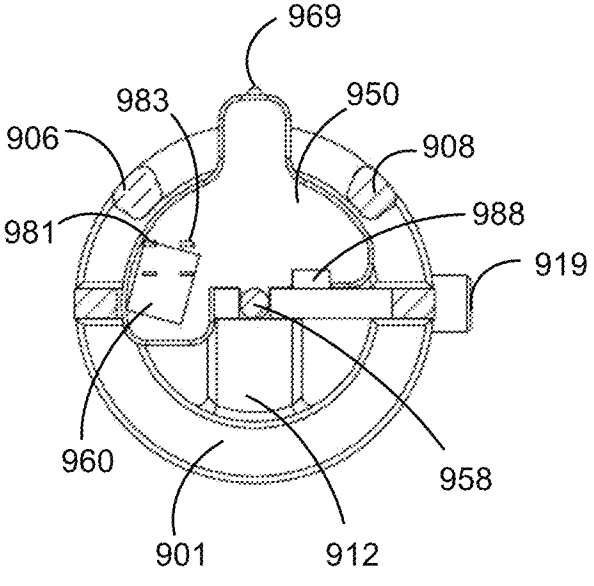
Figure 20A:
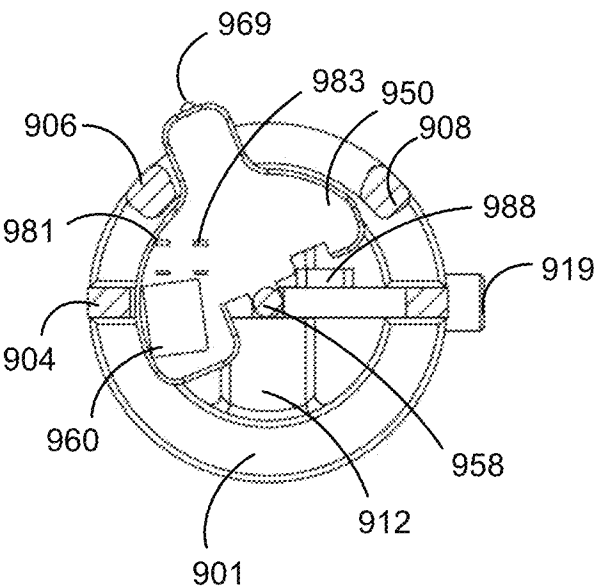
Figure 21C:
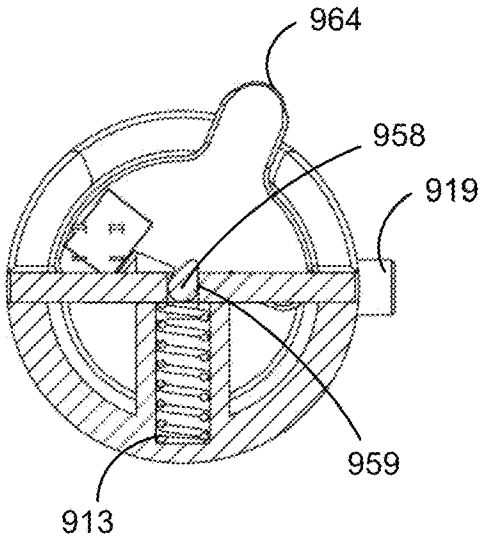
FIGS. 21A to 21C show sectional views of the vane assembly of FIG. 16 with the vane in different positions.
Figure 21B:
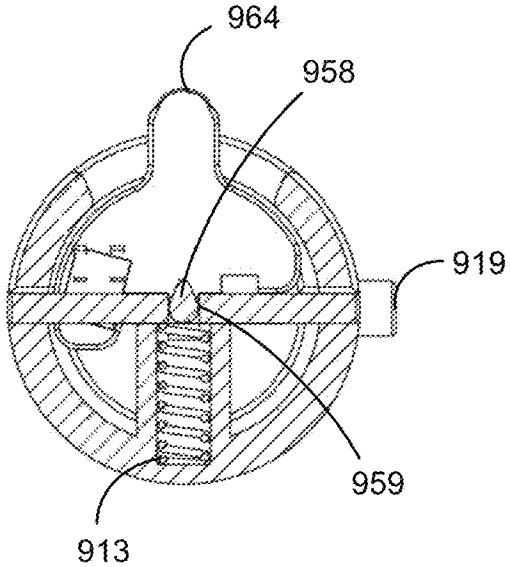
Figure 21A:
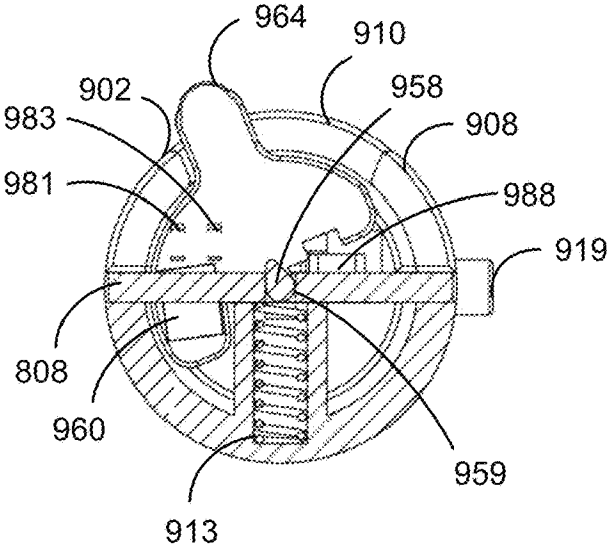

At a first position, the vane 950 is oriented such that the circuit board contact pad 960 and the circuit board power source coupler 980 are not coupled (e.g. FIGS. 20A and 21A). Since the circuit board 808 and power source 114 are not electrically coupled, the electronic flare is in an off state.

When the external switch portion 827 is rotated to a second position, the vane 950 is oriented such that the circuit board contact pad 960 and the circuit board power source coupler 980 are electrically coupled (e.g. FIGS. 20B and 21B). When the circuit board contact pad 960 and the circuit board power source coupler 980 are coupled, a light transmitter 986 generates light, and the light is transmitted to a phototransistor 988, which then detects the light. The vane 950 has a light vent 962 (e.g. notch). The light vent 962 allows the light from the light transmitter 986 to reach the phototransistor 988 when in the vane 950 is in the second position. When the controller determines that light is detected by the phototransistor 988, the controller controls the electronic flare 800 to enter another lighting mode.

When twist switch 826 is rotated to a third position, the light vent 962 is rotated such that the light from the light transmitter 986 can no longer reach the phototransistor 988, interrupting the light transmission to the phototransistor 988 (e.g. FIGS. 20C and 21C). When the light transmission is interrupted, a signal is sent to the controller and the lighting mode is changed.

The use of a mechanical switch (i.e. the vane) may help reduce power drain on the power source 114 when the electronic flare 800 is in the off position because the power source 114 is disconnected from the circuit board 808. In some embodiments, rather than emitting continuous light from the light transmitter 986, the controller may cause the light transmitter 986 to pulse its light transmission. Pulsing the light transmission may help reduce power drain on the power source 114. For example, the light transmitter 986 may transmit light every other half of a second. In such embodiments, the phototransistor 988 can signal the controller when there has been a delay greater than a half of a second, indicating that the switch has been twisted, and the controller may change the lighting mode.

In some embodiments, the vane assembly 900 may allow the electronic flare 800 to operate in more than two lighting modes. For example, the controller may be programmed to measure the duration of time that the vane 950 spends in each position. Depending on the time spent in each position, more sequences or other operating functions may be triggered. For example if the twist switch 826 were quickly rotated to the third position and back to the second position, a different lighting mode may be triggered compared to just rotating the twist switch to the third position or to the second position. This mechanism may be extended to three, four, or more quick movements to change between a larger number of lighting modes.

In some embodiments, the electronic flare 800 may have a plurality of light transmitter/phototransistor pairs. The plurality of lighting pairs may allow the controller to detect more vane positions and operate in more lighting modes through use of a binary or gray code. For example, there may be a first transmitter/phototransistor pair and a second transmitter/phototransistor pair. When the light that is transmitted between both transmitter/phototransistor pairs are covered by the vane (i.e. representing 0 0), the electronic flare 800 may be in a first lighting mode. When the light between only the first transmitter/phototransistor pair is covered (i.e. representing 0 1), the electronic flare 800 may be in a second lighting mode. When the light between only the second transmitter/phototransistor pair is covered (i.e. representing 1 0), the electronic flare 800 may be in a third lighting mode. When the light between both the transmitter/phototransistor pairs are uncovered, e.g. not blocked, (i.e. representing 1 1), the electronic flare 800 may be in a fourth lighting mode.

In some embodiments, the electronic flare 800 may use a switching power supply inductor to regulate the higher voltage of the power source 114 down to the lower voltage needed by the at least one light source 812. For example, referring to FIG. 16, shown therein is a switching power supply inductor 992. The power supply inductor 992 reduces the voltage transmitted to the at least one light source 812 from the power source 114. This power switching allows the at least one light source 812 to operate until the power source 114 is fully discharged, resulting in longer operating time.

Figure 27B:
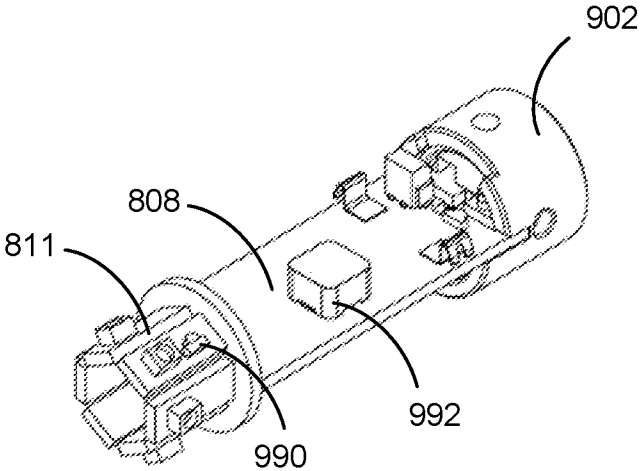
FIGS. 27A to 27E show the stages of assembly of the electronic flare of FIG. 15A.
Figure 27A:
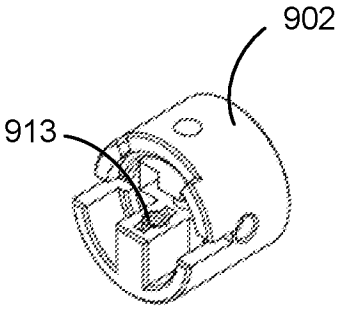
Figure 27E:
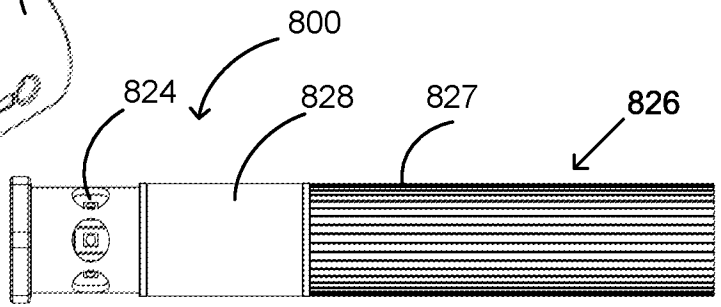
Figure 27D:
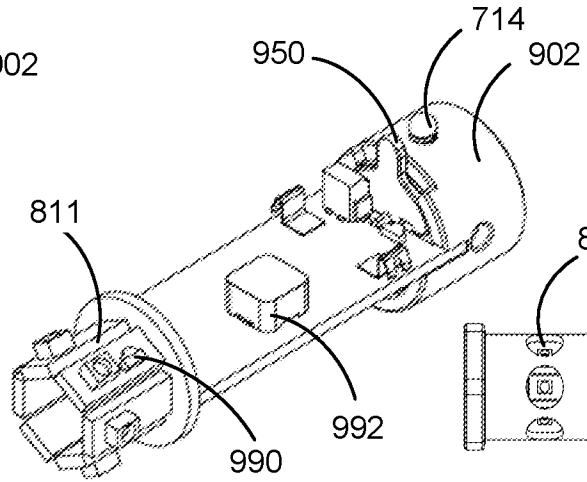
Figure 27C:
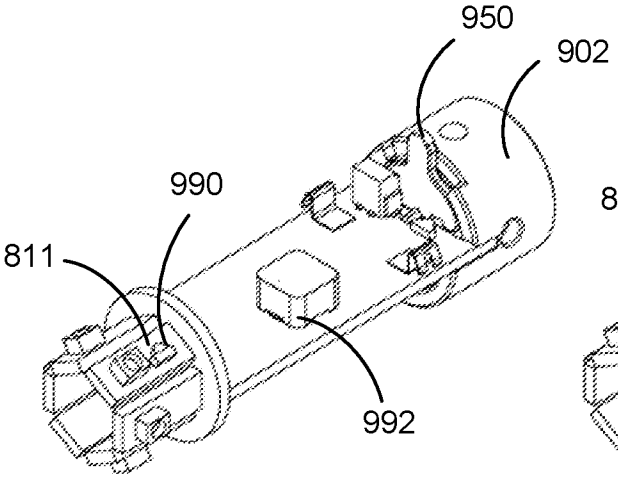
Figure 28B:
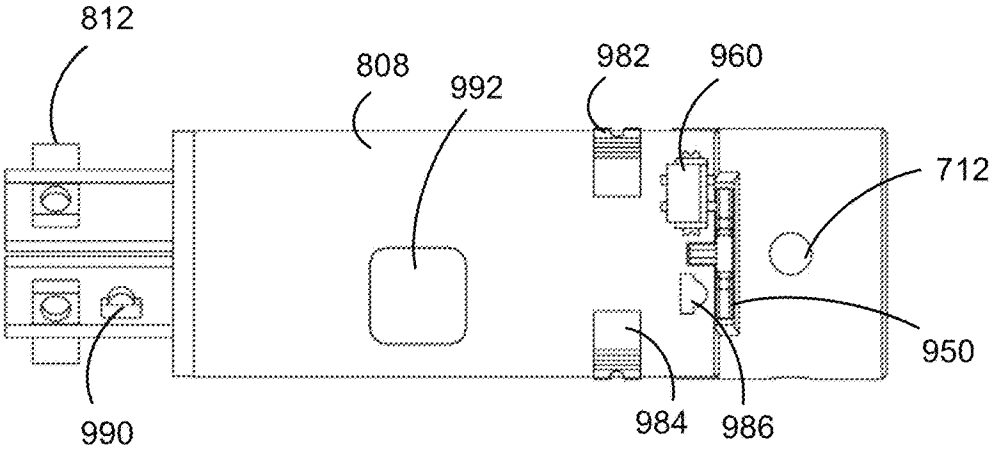
FIGS. 28A to 28D show the circuit board and the vane assembly of FIG. 16 with the containment tube removed.
Figure 28A:
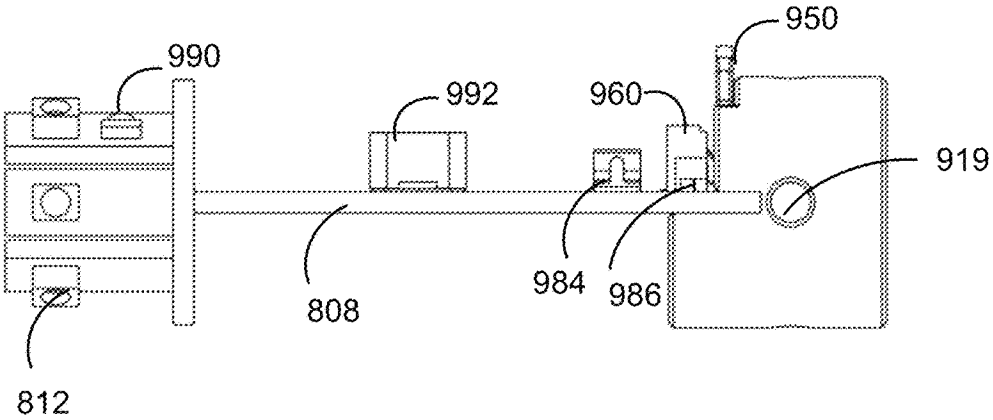
Figure 28D:
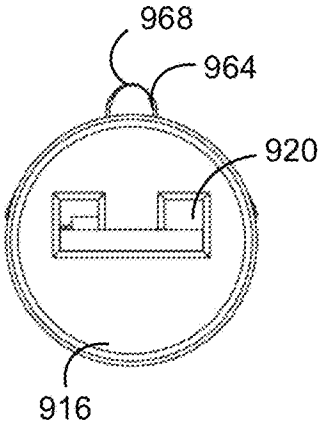
Figure 28C:
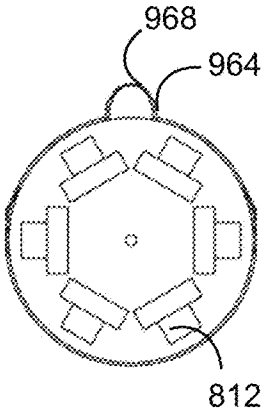

Referring now to FIGS. 27A to 27E, shown therein is the electronic flare 800 with the vane assembly 900 at various stages of assembly. In FIG. 27A, the vane spring 913 has been inserted into the vane support 902. In FIG. 27B, the circuit board 808 and light assembly 811 have been inserted into the vane support 902. In FIG. 27C, the vane 950 has been fitted into position in the vane support 902 and the circuit board 808. In FIG. 27D, the spring 716 and the ball bearings 714 and 715 are positioned in the vane support 902. In FIG. 27E, the external switch portion 827 and inner tube 828 are placed over the circuit board 808 and the vane support 902.

In some embodiments, the electronic flare 800 may have an ambient light sensor. For example, referring to FIGS. 28A to 28D, shown therein is a portion of the electronic flare 800 with an ambient light sensor 990 (e.g. a photosensor 990). The ambient light sensor 990 may be electrically coupled to the circuit board 808 and may be adapted to sense ambient light. When the photosensor 990 is exposed to a low amount of ambient light, the controller may be configured to decrease power to the at least one light source 812 to decrease an amount of emitted light when the light module is activated. Decreasing the amount of emitted light may result in longer operating time. When the photosensor 990 is exposed to a high amount of ambient light, the controller may be configured to increase power to the at least one light source 812 to increase an amount of emitted light when the light module is activated. Increasing the amount of emitted light may improve the visibility of the electronic flare during the daytime or when the flare is exposed to another light source.

In some example embodiments of the electronic flare 100, the length of the electronic flare 100 may be approximately 200 mm. In some example embodiments of the electronic flare 100, the length of the electronic flare 100 may be longer than 200 mm while in some other example embodiments the length of the electronic flare 100 may be shorter than 200 mm such as about 165 mm or 150 mm, for example. In some embodiments, the diameter of the electronic flare 100 may be approximately 25 mm. In some embodiments, the length of the twist switch 106 may be approximately 85 mm.

In some example embodiments of the electronic flare 800, the length of the electronic flare 800 may be approximately 160 mm and in some cases longer. In some embodiments, the diameter of the electronic flare 800 may be approximately 30 mm. In some embodiments, the length of the twist switch 826 may be approximately 95 mm.

Please note that the above dimensions are provided as examples and other values may be used for the length and diameter for other embodiments.

In some alternative embodiments of the electronic flare 100, 800 the tactile mechanism may be incorporated into the second support 120, 822 on the upper end of the circuit board 118, 808. In such embodiments, the second support 120, 822 has an accommodation for the ball bearing and spring.

In some alternative embodiments of the electronic flare 100, 800 there may be at least one ridge along the exterior of the inner tube 142, 828 such that the rotation of the twist switch 106, 826 over the at least one ridge produces a click or vibration. The at least one ridge may be positioned such that the click or vibration felt by the user corresponds to the electronic flare entering one of the lighting modes. Another ridge may be positioned such that the vibration felt by the user corresponds to another lighting mode. There may be as many ridges as the electronic flare has lighting modes, such that rotation of the twist switch 106, 826 to activate any lighting mode produces tactile feedback.

In some alternative embodiments of the electronic flare 100, 800 the tactile feedback may be haptic. The haptic feedback may be provided by a haptic motor that is coupled to the twist switch 106, 826 such that rotation of the twist switch 106, 826 activates the haptic motor, which generates a click or a vibration that is felt by the user. As with the embodiments with the at least one ridge on the exterior of the inner tube 142, 828, there may be as many clicks or vibrations as there are different lighting modes of the electronic flare, such that rotation of the twist switch 106, 826 to place the electronic flare into a different lighting mode results in a different haptic feedback (i.e. different intensities of the click or different intensities and/or frequencies of the vibration for different lighting modes).

In some embodiments, the electronic flare 100 may have a retracted position and an extended position. In the retracted position, the light module may be partially encompassed by the twist switch 106 or the outer tube 110 such that any light that is emitted by the light module is not visible. Also in the retracted position, the light module is protected from the external environment since it is covered and has a locking mechanism that is engaged. When a twisting action is applied to the electronic flare, the locking mechanism is disengaged and the light module slides out into the extended position. Alternatively, in these embodiments, the electronic flare may contain a spring connected to a release button such that when the release button is pressed, the electronic flare extends from the retracted position to the extended position in which the length of the electronic flare is increased. In either of these embodiments when the light module 108 is in the extended position, the light module 108 is no longer encompassed by the external switch portion 107 or the outer tube 110, and any light that is emitted by the light module 108 is visible. When the user no longer needs to use the electronic flare, the user may then push the light module 108 into the electronic flare housing, engaging the release switch, returning the electronic flare to the retracted position and turning the electronic flare off. The electronic flare may also have an optical sensor electrically connected to the circuit board that may determine when the electronic flare is in the retracted position or the extended position. When in the retracted position, the controller on the circuit board may turn the light module off. When in the extended position, the controller on the circuit board may turn the light module on.

In some alternative embodiments, the electronic flare may have at least one additional light source apart from the light sources in the light module. The at least one additional light source may be embedded into the external switch portion 107 or the outer tube 110. When the electronic flare is in an activated state, the at least one additional light source may emit light. The at least one additional light source may indicate to the user that the electronic flare is in an activated state.

In some alternative embodiments, the light module may be activated by an alternative method other than the actuation mechanism described above. For example, the electronic flare may be activated by experiencing an impact that is sensed by a force sensor. The electronic flare may be activated by an impact to any part of the electronic flare that can be sensed by the force sensor. For example, striking the electronic flare against a hard surface, such as the ground or the palm of a user's hand, will enter the electronic flare into an impact mode and activate the light module. Activation by impact is beneficial for single-handed operation such as by emergency service personnel who are typically holding other necessary tools in the other hand. As another example, the electronic flare may be dropped from an airborne position and when it impacts a ground surface this is detected by the force sensor and the electronic flare is then activated to emit a light.

In some embodiments, the light module may be activated by a water sensor. The water sensor may detect when the electronic flare is submersed in water. For example, a user may throw the electronic flare off a boat and have the light module activate upon submersion.

In some embodiments, there may be more than one impact mode. To switch between impact modes, a user may provide an impact to the electronic flare more than once. Each impact that is given to the electronic flare may change the lighting mode of the electronic flare.

In some embodiments, the electronic flare may have a photosensor. The photosensor may be connected to the outer tube 110 and may be in communication with the circuit board. The controller on the circuit board may determine the amount of ambient light by using the photosensor. When there is a high amount of ambient light, the controller may dim or reduce the amount of light that is emitted by the light source of the electronic flare. As the amount of ambient light decreases, the controller may automatically increase the amount of light emitted by the light source of the electronic flare. For example, during the day, when there is sufficient light, the electronic flare may decrease in brightness in order to preserve battery life. During the night, when there is an absence of light, the electronic flare may increase in brightness to improve visibility.

In some alternative embodiments, the electronic flare may have more than one activation method, such as at least two of a twist switch, a button, an impact sensor, and a sensor that detects being submersed in water. More than one activation mechanism allows a user to activate the electronic flare and select a particular lighting mode in the event that the user does not have the ability to use two hands to twist the electronic flare. For example, the user can use one hand to actuate the button or to provide an impact to the electronic flare.

In at least some embodiments, the electronic flare may have a heat resistance by employing materials and/or coatings that have been developed to withstand heat that may be experienced in a fire. Alternatively, or in addition thereto, in at least some embodiments, the electronic flare may be waterproof by using gaskets and sealing materials so that the electronic flare is waterproof up to a certain water depth that may be experienced during water rescue situations. Alternatively, or in addition thereto, in some embodiments, the electronic flare may be made of durable materials and have certain internal components that are shock resistant so that the electronic flare is able to withstand a certain amount of force and not break if the electronic flare were dropped from a certain height such as from a helicopter or from an upper floor of a building.

The following are a series of examples intended to illustrate the possible uses and benefits of an electronic flare as disclosed herein. The size and weight of the electronic twist flare facilitates its use in many scenarios, as it can fit in a cargo pant pocket or a small compartment, and is easily transportable. For example, the size and weight of the electronic flare can be varied to facilitate specific needs, customer specific requirements and uses in certain situations. The following examples are not intended to limit the applicant's teachings in any way.

In one example, flares are often used at the sites of automobile accidents. Pyrotechnic flares provide a bright light to which emergency personnel are drawn. However, pyrotechnic flares are dangerous. A user must ignite the flare, which then burns at a high temperature and may cause the user to burn themselves or their clothing shortly after the flare is lit. Further, automobile accidents often result in spilled flammable liquids such as oil and gas. The use of pyrotechnic flares may ignite the flammable liquids and increase the risk of harm to the accident victim. In addition, pyrotechnic flares have a limited lifespan. A pyrotechnic flare may burn out before emergency personnel can locate the victim of an automobile accident. Once the victim of the automobile accident has been rescued, the emergency personnel may need to purchase additional pyrotechnic flares to replace those used during the emergency.

However, an electronic flare, in accordance with one of the embodiments described herein, may be used to guide emergency personnel to the site of the accident victim. The electronic flare may be placed at any position around the site of the accident, without fear that the flare will ignite the flammable liquids. In addition, the electronic flare may have a lifespan that is significantly greater than the lifespan of a pyrotechnic flare. For example, testing has shown that a pyrotechnic flare may be able to burn from about 15 to 30 minutes on average. In contrast, the electronic flares described herein can operate consecutively for a time span that is much longer such as 22 hours, for example, as evidenced by testing conducted by the inventors. Further, if the power source of the electronic flare is depleted, it may be replaced with a new power source. In contrast, pyrotechnic flares are single-use. In contrast, with the electronic flare, a user merely has to replace the power source or recharge the battery, thereby allowing for multiples uses.

In another example, an electronic flare according to at least one of the embodiments described herein may provide benefits in marine use. Many jurisdictions have regulations that require boats to have emergency flares located onboard. Pyrotechnic flares may expire after a few years, and need to be replaced in order to adhere to the marine regulations. An electronic flare, as described herein, need not be replaced. A user can merely recharge or replace the power source, thereby saving the user the cost of purchasing additional pyrotechnic flares.

During marine use, a user may attach a flotation mount to an electronic flare, as described herein, to prevent the electronic flare from sinking. Even if the boat sinks, the electronic flare will remain above the water surface, increasing the likelihood of rescue. Additionally, as described above, an electronic flare reduces the risk of igniting flammable liquids. At the site of a boat accident, there is often oil and gas that floats on the surface of the water. The use of a pyrotechnic flare may ignite these liquids, causing further harm to the victim. An electronic flare may be able to float on the surface of the water without causing additional harm to the victim.

In another example, an electronic flare in accordance with at least one of the embodiments described herein may be used at the site of a forest fire. Unlike a pyrotechnic flare, the electronic flare may be used without causing additional fires. Additionally, the electronic flare may be programmed to change the colour of emitted light depending on the circumstances. For example, when being used in a forest fire situation, the electronic flare may be programmed to use a colour that maximizes visibility within the fire.

In another example, an electronic flare in accordance with at least one of the embodiments described herein may be used during military operations. A pyrotechnic flare only emits light of a single colour. A user of an electronic flare may change the colour of the light as needed. For example, an infrared LED may be used for military operations to provide infrared light to users with night-vision goggles, which may increase the chance of the operation's success.

In another example, one or more of the electronic flares described herein may be used to replace or aid the use of safety triangles that people use to indicate that a car or transport vehicle has broken down. The light from the electronic flare may be adjusted to make drivers of vehicles aware well in advance of a stopped car or truck that is on the side of the road. Often drivers have to be very close to a broken down vehicle before they see these conventional triangles during the day or their headlights reflect off these conventional triangles at night. This problem can be avoided using the electronic flares described in accordance with the teachings herein.

In another aspect, an electronic flare kit may be provided that comprises one of the electronic flares described herein where the electronic flare comprises a long tubular housing; a light module that is disposed along a portion of the housing, the light module comprising at least one light source for emitting light according to a lighting mode; a power source for providing power to the light module; a circuit board that is disposed within the housing and is electrically coupled to the power source and light module, the circuit board including a controller for providing power to the light module according to the selected lighting mode when the electronic flare is activated; and a switch having an external switch portion and an internal switch portion that is coupled to the external switch portion, the external switch portion being disposed along an outer portion of the housing and the internal switch portion being operatively coupled to the circuit board, the external switch portion being rotatably movable by a user to one or more positions where each position is associated with a different lighting mode allowing the user to select the lighting mode.

In at least one embodiment, the kit may further comprise at least one additional lighting module that is removably attachable to the housing of the electronic flare, the additional lighting module having a different light color when illuminated.

In at least one embodiment, the electronic flare of the kit may further comprise an end cap shaped to receive a removably attachable mount that has a pointed end for allowing the electronic flare to be mounted on a soft surface.

In at least one embodiment, the electronic flare of the kit may further comprise a removably attachable mount that has at least one clamp that is coupled to a stand, the at least one clamp being sized to receive the housing and couple the mount to the housing to maintain the electronic flare at an upright position on a surface.

In at least one embodiment, the electronic flare of the kit may have a stand that is pivotally coupled to the clamp to allow an angle between the housing of the electronic flare and the surface to be adjusted.

In at least one embodiment, the kit may further comprise instructions describing how the electronic flare is operated by a user. Alternatively, instructions in the kit may not be included as the electronic flare and the various parts of the kit are self-explanatory. In another alternative, the instructions may be provided on a website.

While the applicant's teachings described herein are in conjunction with various embodiments for illustrative purposes, it is not intended that the applicant's teachings be limited to such embodiments. On the contrary, the applicant's teachings described and illustrated herein encompass various alternatives, modifications, and equivalents, without departing from the embodiments described herein, the general scope of which is defined in the appended claims.

The invention claimed is:

1. An electronic flare comprising:

a long tubular housing;

a light module that is disposed along a portion of the housing, the light module comprising at least one light source for emitting light according to a lighting mode;

a power source for providing power to the light module;

a circuit board that is disposed within the housing and is electrically coupled to the power source and light module, the circuit board including a controller for providing power to the light module according to the selected lighting mode when the electronic flare is activated;

a switch having an external switch portion and an internal switch portion coupled to one another, the external switch portion being disposed along an outer portion of the housing and the internal switch portion being operatively coupled to the circuit board, the external switch portion being rotatably movable by a user to one or more positions where each position is associated with a different lighting mode allowing the user to select the lighting mode; and a tactile feedback mechanism to provide the user with tactile feedback when the external switch portion is rotated to different positions, wherein the internal switch portion is a rotary switch and the tactile feedback mechanism comprises a resilient member that is adapted to exert an outwardly radial force on different slots in an internal surface of the rotary switch where each slot corresponds to a lighting mode and actuation of the rotary switch to change from a given lighting mode to another lighting mode results in deflection of the resilient member that provides the tactile feedback to the user.

2. The electronic flare of claim 1, wherein the lighting modes comprise a first mode where the light module is deactivated and an at least one additional lighting mode in which the light module is activated.

3. The electronic flare of claim 2, wherein the at least one additional lighting mode comprises at least one of a second lighting mode where the light module emits a steady light, a third lighting mode where the light module emits a flashing light and a third lighting mode where the light module emits light according to a Morse code pattern.

4. The electronic flare of claim 1, wherein the lighting provided during a given lighting mode is programmable by a user by providing lighting instructions to the controller.

5. The electronic flare of claim 1, wherein the light module comprises:

a light source containment member that provides a housing for the light module;

at least one light source contact holder for supporting the at least one light source; and at least one light source contact member that is electrically connectable to the at least one light source and the circuit board for providing power to the at least one light source depending on the selected lighting mode.

6. The electronic flare of claim 1, wherein the light module is removably attachable to the housing allowing the light module to be replaced when any of the light sources are damaged or allowing the light module to be replaced with another light module having light sources that emit light of a different color.

7. The electronic flare of claim 1, wherein the external switch portion has a rough surface allowing the user to more easily grip and actuate the switch.

8. The electronic flare of claim 1, wherein the circuit board comprises a plurality of electrical contacts that are physically located at different positions that correspond to the different positions that the rotary switch is movable to so that during use the user rotates the external switch portion which in turn rotates the rotary switch to select one of the lighting modes.

9. The electronic flare of claim 1, wherein the internal switch portion has an internal surface that includes different optical markers that are spaced apart and correspond to different lighting modes, the circuit board comprises an optical detector for detecting the optical markers and during use the rotary switch is rotated by rotation of the external switch portion to allow one of the optical markers to be detected by the optical detector to allow the user to select the lighting mode associated with the detected optical marker.

10. The electronic flare of claim 1, wherein the resilient member comprises a spring and the tactile feedback mechanism comprises a ball bearing that is at an end of the spring and is disposed within the slot corresponding to the given lighting mode and during actuation, the spring is compressed when the rotary switch is rotated until the ball bearing is moved to another slot corresponding to a different lighting mode at which point the spring is adapted to move from a contracted to an extended position to provide the tactile feedback to the user.

11. The electronic flare of claim 1, wherein the resilient member comprises a spring and the tactile feedback mechanism comprises two ball bearings that are at opposite ends of the spring and are disposed within the a pair of slots that correspond to the given lighting mode and during actuation, the spring is compressed when the rotary switch is rotated until the ball bearings are moved to another pair of slots that correspond to a different lighting mode at which point the spring is adapted to move from a contracted to an extended position to provide the tactile feedback to the user.

12. The electronic flare of claim 1, wherein the electronic flare further comprises:

an activation block having a recess, the activation block being coupled to the external switch portion such that rotation of the external switch portion rotates the activation block; and the rotary switch has a protrusion that corresponds to the recess of the activation block, the rotary switch protrusion being coupled to the activation block recess such that the rotary switch is adapted to rotate upon rotation of the activation block rotates.

13. The electronic flare of claim 1, wherein the internal switch portion comprises:

at least one light transmitter coupled to the circuit board;

a vane assembly comprising:

a support block coupled to the housing;

at least one phototransistor that is associated with the at least one light transmitter, the at least one phototransistor being configured for receiving light from the at least one phototransistor light source; and a vane that is rotatably coupled to the support block and coupled to the external switch portion, the vane having a light vent, the vane being adapted to rotate when the external switch portion is rotated to allow transmitted light from the at least one light transmitter to be detected by the associated at least one phototransistor when the vane is therebetween and the vane being adapted to block the light otherwise, wherein the controller is adapted to switch the lighting mode when the associated at least one light transmitter transitions between detecting and not detecting the transmitted light from the at least one light phototransmitter.

14. The electronic flare of claim 13, further comprising a first lighting mode when the at least one phototransistor detects the transmitted light and a second lighting mode when the at least one phototransistor does not detect the transmitted light.

15. The electronic flare of claim 13, further comprising a first light phototransistor for detecting light from a first light transmitter and a second phototransistor for detecting light from a second light transmitter and the controller is configured to enter select different lighting modes depending on whether one or both of the phototransistors detect transmitted light.

16. The electronic flare of claim 15, wherein the controller is further configured to use any one of a binary code and a gray code to change between the lighting modes depending on which of the phototransistors detect transmitted light.

17. The electronic flare of claim 13, wherein the controller is configured to determine time durations during which the light vane is in a particular position during a sequence of rotations of the vane and the controller is configured to select a lighting mode based on the determined time durations and changes in rotation direction for the sequence of rotations has at least a first lighting position and a second lighting position.

18. The electronic flare of claim 1, wherein the power source is a battery disposed at an end of the electronic flare.

19. The electronic flare of claim 18, wherein the battery is rechargeable and an end cap that is adjacent to the battery comprises electrical contacts to facilitate direct electrical charging or charging occurs through wireless induction.

20. The electronic flare of claim 1, wherein the electronic flare comprises sealing elements disposed along different physical and/or removable sections of the housing to seal keep fluids from entering the housing.

21. The electronic flare of claim 1, wherein the electronic flare comprises an alternate activation mechanism including a button that is actuated by a user to select one of the lighting modes.

22. The electronic flare of claim 1, wherein the electronic flare comprises an alternate activation mechanism including an impact switch that is actuated by a user by exerting an external impact force on the housing to select one of the lighting modes.

23. The electronic flare of claim 1, further comprising a photosensor that is electrically coupled to the circuit board and is adapted to sense ambient light, and when the photosensor is exposed to a low amount of ambient light the controller is configured to increase power to the light module to increase an amount of emitted light when the light module is activated and when the photosensor is exposed to a high amount of ambient light the controller is configured to decrease power to the light module to decrease an amount of emitted light when the light module is activated.

24. The electronic flare of claim 1, wherein an end cap is shaped to receive a removably attachable mount that has a pointed end for allowing the electronic flare to be mounted on a soft surface.

25. The electronic flare of claim 1, further comprising a removably attachable mount that has at least one clamp that is coupled to a stand, the at least one clamp being sized to receive the housing and couple the mount to the housing to maintain the electronic flare at an upright position on a surface.

26. The electronic flare of claim 25, wherein the stand is pivotally coupled to the clamp to allow an angle between the housing of the electronic flare and the surface to be adjusted.

27. An electronic flare kit comprising:

an electronic flare comprising:

a long tubular housing;

a light module that is disposed along a portion of the housing, the light module comprising at least one light source for emitting light according to a lighting mode;

a power source for providing power to the light module;

a circuit board that is disposed within the housing and is electrically coupled to the power source and light module, the circuit board including a controller for providing power to the light module according to the selected lighting mode when the electronic flare is activated; and a switch having an external switch portion and an internal switch portion that is coupled to the external switch portion, the external switch portion being disposed along an outer portion of the housing and the internal switch portion being operatively coupled to the circuit board, the external switch portion being rotatably movable by a user to one or more positions where each position is associated with a different lighting mode allowing the user to select the lighting mode; and at least one additional lighting module that is removably attachable to the housing, the additional lighting module having a different light color when illuminated.

28. The kit of claim 27, wherein the electronic flare further comprises an end cap shaped to receive a removably attachable mount that has a pointed end for allowing the electronic flare to be mounted on a soft surface.

29. The kit of claim 27, wherein the electronic flare further comprises a removably attachable mount that has at least one clamp that is coupled to a stand, the at least one clamp being sized to receive the housing and couple the mount to the housing to maintain the electronic flare at an upright position on a surface.

30. The kit of claim 29, wherein the stand is pivotally coupled to the clamp to allow an angle between the housing of the electronic flare and the surface to be adjusted.

* * * * *